US009904204B2

(12) United States Patent
Iwanaga et al.

(10) Patent No.: US 9,904,204 B2
(45) Date of Patent: Feb. 27, 2018

(54) UNIT FOR IMAGE FORMING APPARATUS, PROCESS CARTRIDGE, IMAGE FORMING APPARATUS, AND ELECTROPHOTOGRAPHIC PHOTORECEPTOR

(71) Applicant: FUJI XEROX CO., LTD., Tokyo (JP)

(72) Inventors: Takeshi Iwanaga, Kanagawa (JP); Takashi Imai, Kanagawa (JP); Hideya Katsuhara, Kanagawa (JP); Masaki Hirakata, Kanagawa (JP); Yoichi Kigoshi, Kanagawa (JP); Nobuyuki Torigoe, Kanagawa (JP); Fumiaki Mera, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/015,590

(22) Filed: Feb. 4, 2016

(65) Prior Publication Data

US 2017/0090339 A1 Mar. 30, 2017

(30) Foreign Application Priority Data

Sep. 25, 2015 (JP) ..... 2015-188326

(51) Int. Cl.
*G03G 5/147* (2006.01)
*G03G 15/04* (2006.01)
(Continued)

(52) U.S. Cl.
CPC ..... *G03G 15/04036* (2013.01); *G03G 5/0436* (2013.01); *G03G 21/1814* (2013.01)

(58) Field of Classification Search
CPC ..... G03G 5/14704
See application file for complete search history.

(56) References Cited

U.S. PATENT DOCUMENTS 5,242,773 A 9/1993 Iino et al.
5,242,776 A 9/1993 Doi et al.
(Continued)

FOREIGN PATENT DOCUMENTS

JP H04-175767 A 6/1992
JP H05-53487 A 3/1993
(Continued)

OTHER PUBLICATIONS

Aug. 8, 2017 Office Action issued in Japanese Patent Application No. 2015-188326.

*Primary Examiner* — Hoa V Le
(74) *Attorney, Agent, or Firm* — Oliff PLC

(57) ABSTRACT

A unit for an image forming apparatus includes an electrophotographic photoreceptor that includes a conductive substrate, a photosensitive layer provided on the conductive substrate, and a surface layer provided so as to contact with an outermost surface of the photosensitive layer, and an exposure section that exposes the electrophotographic photoreceptor with a light having a wavelength (λ) (nm) so as to form an electrostatic latent image on a charged surface of the electrophotographic photoreceptor, wherein a surface roughness (Rz1) (nm) of the outermost surface of the photosensitive layer satisfies an expression of [(Rz1)≥(λ)/(4×(n2))] where a refractive index of the surface layer is set as (n2), and an outermost surface of the surface layer has a surface shape different from the outermost surface of the photosensitive layer.

13 Claims, 10 Drawing Sheets

(51) Int. Cl.

| | |
|---|---|
| ***G03G 5/043*** | (2006.01) |
| ***G03G 21/18*** | (2006.01) |

(56) References Cited

U.S. PATENT DOCUMENTS

| | | | |
|---|---|---|---|
| 6,531,253 | B2 | 3/2003 | Kawada et al. |
| 2014/0295334 | A1 | 10/2014 | Hirakata et al. |

FOREIGN PATENT DOCUMENTS

| | | | |
|---|---|---|---|
| JP | 2001-281896 | A | 10/2001 |
| JP | 2002-82463 | A | 3/2002 |
| JP | 2006-267507 | A | 10/2006 |
| JP | 2014-191179 | A | 10/2014 |

UNIT FOR IMAGE FORMING APPARATUS, PROCESS CARTRIDGE, IMAGE FORMING APPARATUS, AND ELECTROPHOTOGRAPHIC PHOTORECEPTOR

CROSS-REFERENCE TO RELATED APPLICATIONS

This application is based on and claims priority under 35 USC 119 from Japanese Patent Application No. 2015-188326 filed Sep. 25, 2015.

BACKGROUND

1. Technical Field

The present invention relates to a unit for an image forming apparatus, a process cartridge, the image forming apparatus, and an electrophotographic photoreceptor.

2. Related Art

In the related art, as an electrophotographic image forming apparatus, a device which sequentially performs processes of charging, formation of an electrostatic latent image, developing, transfer, cleaning, and the like by using an electrophotographic photoreceptor has been widely known.

As the electrophotographic photoreceptor, a function separation type photoreceptor and a single-layer type photoreceptor have been known. In the function separation type photoreceptor, a charge generating layer and a charge transport layer are layered on a substrate having conductivity. In the charge generating layer, charges are generated. In the charge transport layer, charges are transported. In the single-layer type photoreceptor, the same layer handles a function of generating charges and a function of transporting charges. A photoreceptor in which a protective layer is provided on a photosensitive layer so as to achieve a longer service life of such a photoreceptor is examined from before.

SUMMARY

According to an aspect of the invention, there is provided a unit for an image forming apparatus, including:

an electrophotographic photoreceptor that includes a conductive substrate, a photosensitive layer provided on the conductive substrate, and a surface layer provided so as to contact with an outermost surface of the photosensitive layer; and an exposure section that exposes the electrophotographic photoreceptor with a light having a wavelength (λ) (nm) so as to form an electrostatic latent image on a charged surface of the electrophotographic photoreceptor, wherein a surface roughness (Rz1) (nm) of the outermost surface of the photosensitive layer satisfies an expression of $[(Rz1)\geq(\lambda)/(4\times(n2))]$ where a refractive index of the surface layer is set as (n2), and an outermost surface of the surface layer has a surface shape different from the outermost surface of the photosensitive layer.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described in detail.

Unit for Image Forming Apparatus

A unit for an image forming apparatus according to this exemplary embodiment includes an electrophotographic photoreceptor and an exposure section.

The electrophotographic photoreceptor includes a conductive substrate, a photosensitive layer provided on the conductive substrate, and a surface layer provided so as to contact with an outermost surface of the photosensitive layer. The exposure section exposes the electrophotographic photoreceptor with a light having a wavelength (λ) (nm).

When a refractive index of the surface layer is set as (n2), a surface roughness (Rz1) (nm) of the outermost surface of the photosensitive layer satisfies an expression of [(Rz1)≥

(λ)/(4×(n2))]. An outermost surface of the surface layer has a surface shape different from the outermost surface of the photosensitive layer.

Here, the "surface shape" of the outermost surfaces of the surface layer and the photosensitive layer indicates a shape of three-dimensional roughness of a surface and includes a form of which roughness is not recognized, that is, a substantially smooth form.

"The outermost surface of the surface layer having a surface shape different from the outermost surface of the photosensitive layer" means that the surface shape of the outermost surface of the photosensitive layer and the surface shape of the outermost surface of the surface layer do not overlap each other in a thickness direction of the surface layer.

Accordingly, if the surface roughness (Rz1) of the outermost surface of the photosensitive layer satisfies the expression, a case where the outermost surface of the surface layer has a substantially smooth surface shape corresponds to the above sentence of "having a different surface shape". A case where the outermost surface of the surface layer has roughness, but a shape of the roughness does not overlap the shape of the outermost surface of the photosensitive layer in the thickness direction of the surface layer corresponds to the above sentence of "having a different surface shape". That is, a case where waveforms of waves on the outermost surfaces of the surface layer and the photosensitive layer are different from each other, or at least wavelengths thereof are different from each other or amplitudes thereof are different from each other when it is confirmed that roughness of a cross-section of the photosensitive layer and the surface layer has a two-dimensional wave, corresponds to the sentence of "having a different surface shape".

Figure 1:
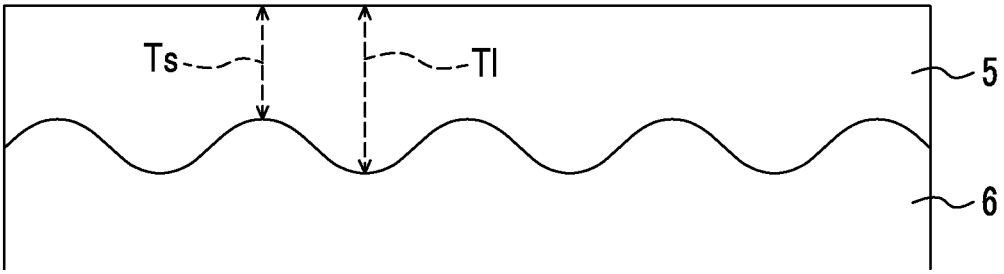
FIG. 1 is a schematic cross-sectional view illustrating enlargement of an example of a photosensitive layer and a surface layer portion of an electrophotographic photoreceptor in this exemplary embodiment.

For example, as illustrated in FIG. 1, a case where the surface roughness (Rz1) of the outermost surface of the photosensitive layer 6 satisfies the above expression and the outermost surface of the surface layer 5 has a substantially smooth surface shape corresponds to the sentence of having of a surface shape different from the outermost surface of the photosensitive layer 6.

Figure 3:
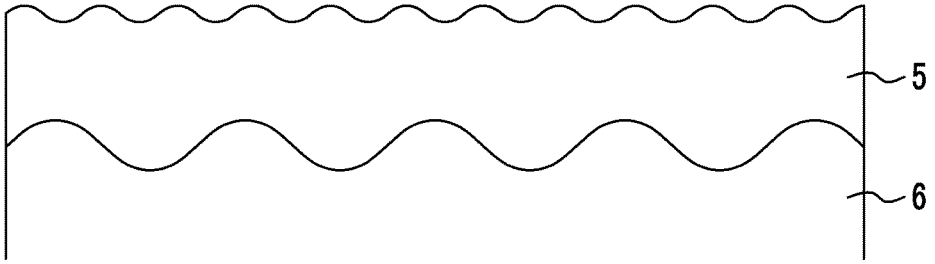
FIG. 3 is a schematic cross-sectional view illustrating enlargement of another example of the photosensitive layer and the surface layer portion of the electrophotographic photoreceptor in this exemplary embodiment.

As illustrated in FIG. 3, a case where the wavelength and the amplitude of roughness of the outermost surface of the surface layer 5 is different from those of roughness of the outermost surface of the photosensitive layer 6 corresponds to the sentence of having of a different surface shape.

Figure 4:
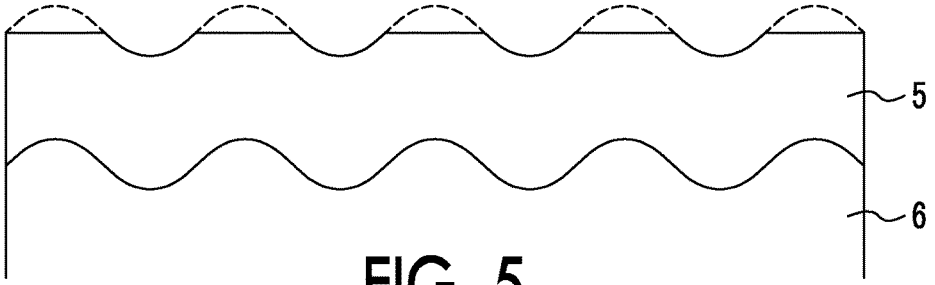
FIG. 4 is a schematic cross-sectional view illustrating enlargement of still another example of the photosensitive layer and the surface layer portion of the electrophotographic photoreceptor in this exemplary embodiment.

As illustrated in FIG. 4, a case where a shape of the roughness of the outermost surface of the photosensitive layer 6 overlaps that of the outermost surface of the surface layer 5 in the thickness direction of the surface layer, but waveforms thereof are different by removing a top portion of a projection portion in the shape of the roughness corresponds to the sentence of having of a different surface shape.

In the related art, density unevenness may occur in an image formed in an electrophotographic image forming apparatus in which an electrophotographic photoreceptor (simply referred to as "a photoreceptor" below) includes a photosensitive layer on a conductive substrate and a surface layer provided so as to contact with the photosensitive layer, and an image is formed by using such a photoreceptor in such a manner that an electrostatic latent image is formed by exposing the photoreceptor with light from the exposure section, and thus an image is finally formed. Particularly, members are provided along with the photoreceptor, and the members are disposed so as to contact with the photoreceptor. For example, a charging member (charging roll and the like), an intermediate transfer member (intermediate transfer belt and the like), a cleaning member (cleaning blade and the like), and the like drives in a state of contacting with the photoreceptor. Thus, uneven wear may occurs on a surface of the photoreceptor due to an influence of a contact status of the photoreceptor with these members after an image is repeatedly formed. In this case, density unevenness may occur between a location at which uneven wear occurs, and the other locations.

On the contrary, in this exemplary embodiment, the surface roughness (Rz1) (nm) of the outermost surface of the photosensitive layer satisfies the expression of [(Rz1)≥(λ)/(4×(n2))] and the outermost surface of the surface layer has a surface shape different from the outermost surface of the photosensitive layer. Thus, occurrence of density unevenness in an image is prevented.

The reason of showing of the effects is supposed unclearly, but considered as follows.

Exposure light incident to the surface layer includes light (referred to as "incident and transmitting light" below) and light (referred to as "reflected and transmitting light" below). The incident and transmitting light refers to light which is incident from the surface layer side and is transmitted to the photosensitive layer through the inside of the surface layer. The reflected and transmitting light refers to light which is reflected by the surface of the photosensitive layer, passes through the inside of the surface layer again, is reflected by the outermost surface thereof again, and is transmitted to the photosensitive layer through the inside of the surface layer. The exposure light has properties of a wave causing interference. Thus, when a phase of the incident and transmitting light and a phase of the reflected and transmitting light overlap each other, both of the incident and transmitting light and the reflected and transmitting light are strengthened (amplified) by the interference. When the phase of the incident and transmitting light is shifted from the phase of the reflected and transmitting light by 180 degrees, both of the rays of light are weakened (destructed) by the interference. That is, an optical interference difference occurs. Locations at which rays of light are strengthened by the interference form an area in which the exposure light is more transmitted to the surface layer. Locations at which rays of light are weakened by the interference form an area in which the exposure light is less transmitted to the surface layer.

Figure 5:
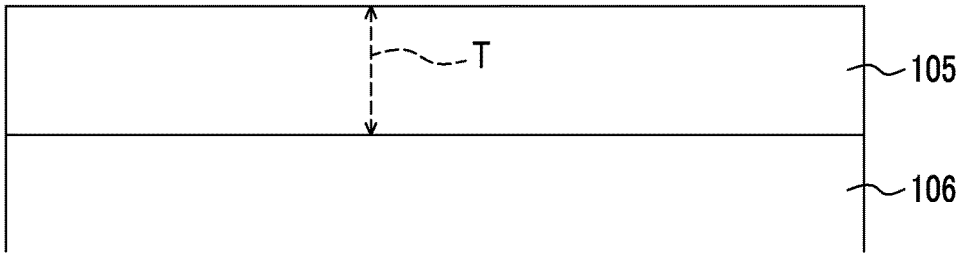
FIG. 5 is a schematic cross-sectional view illustrating enlargement of an example of a photosensitive layer and a surface layer portion of an electrophotographic photoreceptor in the related art.

Here, as an example of a case where the surface roughness (Rz1) (nm) of the outermost surface of the photosensitive layer does not satisfy the expression of [(Rz1)≥(λ)/(4×(n2))], as illustrated in FIG. 5, a form in which the outermost surface of a photosensitive layer 106 has a substantially smooth surface shape without recognition of roughness is considered. If the outermost surface of a surface layer 105 is set to have also substantially smooth surface shape, in the exposure light which is incident in a direction perpendicular to the surface layer, an optical path length of light which is incident from the surface layer 105 side and is reflected by the outermost surface of the photosensitive layer 106 is set to be [2×(T)]. Since formation of the surface layer 105 of which the thickness is not uneven is not easy, a difference in the optical path length may occur in accordance with unevenness in thickness. After an image is repeatedly formed, as illustrated in FIG. 6, the uneven wear may occur on the surface of the photoreceptor, and a difference between an optical path length [$2\times(T_2)$] at a location at which the uneven wear occurs, and an optical path length [$2\times(T_1)$] at the other locations may occur.

In most cases (all cases other than a case where a difference between optical path lengths is exactly an integer times [(λ)/(2×(n2))] regarding the wavelength (λ) of the exposure light), an extent that the incident and transmitting light and the reflected and transmitting light overlap each other in phase varies at a location at which an optical path length has a difference. Thus, an extent of interference between the incident and transmitting light and the reflected and transmitting light also varies. Accordingly, when the surface layer 105 has an uneven thickness, the extent of interference between the incident and transmitting light and the reflected and transmitting light varies depending on the unevenness in thickness, and thus a location at which relative strengthening is performed by interference and a location at which relative weakening is performed by the interference are distinguished from each other. As a result, division into the area in which the exposure light is more transmitted to the surface layer and the area in which the exposure light is less transmitted to the surface layer is performed, and density unevenness of an image occurs in accordance with the unevenness in thickness of the surface layer 105.

Figure 6:
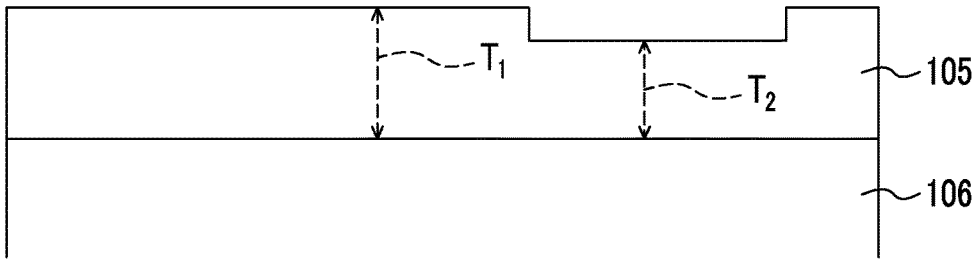
FIG. 6 is a schematic cross-sectional view illustrating enlargement of an example of the photosensitive layer and the surface layer portion after uneven wear of the electrophotographic photoreceptor in the related art occurs.

When the uneven wear occurs as illustrated in FIG. 6, an extent of the interference between the incident and transmitting light and the reflected and transmitting light at the location at which the uneven wear occurs is different from that at the other locations, in accordance with a difference between the thicknesses of the surface layer 105 at a location at which the uneven wear occurs, and the other locations. Thus, division into the area in which the exposure light is relatively more transmitted to the surface layer and the area in which the exposure light is relatively less transmitted to the surface layer is performed, and density unevenness of an image occurs between the location at which the uneven wear occurs, and the other locations.

On the contrary, in this exemplary embodiment, the surface roughness (Rz1) (nm) of the outermost surface of the photosensitive layer satisfies the expression of $[(Rz1) \geq (\lambda)/(4\times(n2))]$. If the outermost surface of the surface layer 5 has a substantially smooth surface shape as illustrated in FIG. 1, in the exposure light which is incident from the surface layer side in the vertical direction and is reflected by the surface of the photosensitive layer, light reflected at the top portion (vertex of the projection portion, that is, portion at which the thickness of the surface layer is indicated by (Ts)) of roughness of the outermost surface of the photosensitive layer has an optical path length which is set as $[2\times(Ts)]$, and light reflected at the bottom portion (vertex of a recessed portion, that is, portion at which the thickness of the surface layer is indicated by (Tl)) of the outermost surface of the photosensitive layer has an optical path length which is set as $[2\times(Tl)]$. Since the surface roughness (Rz1) of the outermost surface of the photosensitive layer satisfies the expression, a difference between the optical path length $[2\times(Ts)]$ and the optical path length $[2\times(Tl)]$ is equal to or greater than $[(\lambda)/(2\times(n2))]$. If the difference in an optical path length between the top portion and the bottom portion is equal to or greater than $[(\lambda)/(2\times(n2))]$, locations at which at least a difference in phase between the incident and transmitting light and the reflected and transmitting light in the exposure light which has been incident is equal to or greater than 180 degrees are mixed in an area from the top portion to the bottom portion. That is, locations at which the incident and transmitting light and the reflected and transmitting light are strengthened (amplified) by interference, and locations at which the incident and transmitting light and the reflected and transmitting light are weakened (destructed) by the interference are mixed in the area from the top portion to the bottom portion. Locations at which strengthening is performed by interference and locations at which weakening is performed by the interference are mixed in a narrow area, which is the area from the top portion to the bottom portion of the roughness on the outermost surface of the photosensitive layer, and thus the entirety of the photoreceptor is in a state where locations at which amplification is performed by interference between the incident and transmitting light and the reflected and transmitting light, and locations at which destruction is performed by the interference therebetween are finely dispersed and present together. For this reason, when viewed in an area wider than the area from the top portion and the bottom portion, the quantity of the exposure light being transmitted to the surface layer are averaged.

As a result, even if the surface layer 5 has unevenness in thickness, occurrence of density unevenness of an image due to interference is prevented.

Figure 2:
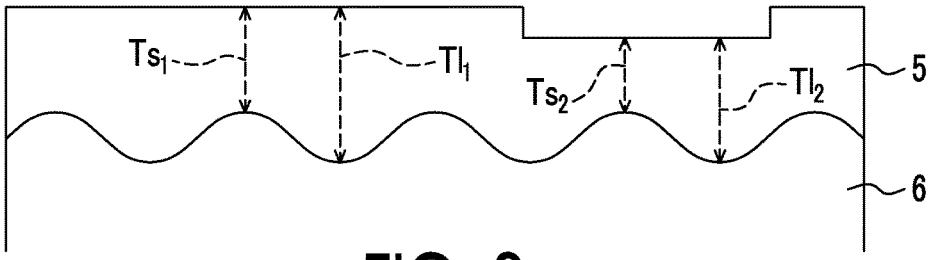
FIG. 2 is a schematic cross-sectional view illustrating enlargement of an example of the photosensitive layer and the surface layer portion after uneven wear of the electrophotographic photoreceptor in this exemplary embodiment occurs.

After an image formation is repeatedly performed, as illustrated in FIG. 2, even when the uneven wear occurs on the surface of the photoreceptor, at a location at which the uneven wear occurs, light reflected at the top portion (portion at which the thickness of the surface layer is indicated by $(Ts_2)$) of roughness of the outermost surface of the photosensitive layer has an optical path length which is set as $[2\times(Ts_2)]$, and light reflected at the bottom portion (portion at which the thickness of the surface layer is indicated by $(Tl_2)$) of the outermost surface of the photosensitive layer has an optical path length which is set as $[2\times(Tl_2)]$. At the other locations, light reflected at the top portion (portion at which the thickness of the surface layer is indicated by $(Ts_1)$) of roughness of the outermost surface of the photosensitive layer has an optical path length which is set as $[2\times(Ts_1)]$, and light reflected at the bottom portion (portion at which the thickness of the surface layer is indicated by $(Tl_1)$) of the outermost surface of the photosensitive layer has an optical path length which is set as $[2\times(Tl_1)]$. In this exemplary embodiment, since any of a difference between the optical path length $[2\times(Ts_2)]$ and the optical path length $[2\times(Tl_2)]$ and a difference between the optical path length $[2\times(Ts_1)]$ and the optical path length $[2\times(Tl_1)]$ is equal to or greater than $[(\lambda)/(2\times(n2))]$, locations at which strengthening is performed by interference and locations at which weakening is performed by the interference are mixed in the narrow area from the top portion to the bottom portion of the roughness of the outermost surface of the photosensitive layer 6.

As a result, strength and weakness (amplification and destruction) by interference are overall averaged at the locations at which the uneven wear occurs and the other locations, and the occurrence of density unevenness of an image due to interference is prevented.

In the above descriptions, as illustrated in FIG. 1, a case in which the outermost surface of the surface layer 5 has a substantially smooth surface shape is described as an example. However, for example, even in the form in which the outermost surface of the surface layer 5 has roughness of a surface shape different from that of the photosensitive layer 6, as illustrated in FIG. 3 or 4, the surface roughness (Rz1) of the outermost surface of the photosensitive layer 6 satisfies the expression of $[(Rz1) \geq (\lambda)/(4\times(n2))]$, and thus a state where locations at which the incident and transmitting light and the reflected and transmitting light are strengthened (amplified) by interference, and locations at which the incident and transmitting light and the reflected and transmitting light are weakened (destructed) by the interference are finely dispersed and present together, occurs. As a result, strength and weakness (amplification and destruction) by interference are averaged in the entirety of the photoreceptor, and the occurrence of density unevenness of an image due to interference is prevented.

In the above descriptions, only the exposure light which is incident in the direction perpendicular to the surface layer 5 is considered. However, exposure light which is incident from a direction inclined to the surface layer 5 has an optical path length longer than that of the exposure light which incident in the direction perpendicular to the surface layer. The exposure light which is incident from a direction inclined to the surface layer 5 has a difference between the optical path length of light reflected at the top portion of the roughness of the outermost surface of the photosensitive layer 6 and the optical path length of light reflected at the bottom portion thereof, and this difference is greater than that of the exposure light which is incident in the vertical direction. For this reason, the surface roughness (Rz1) of the outermost surface of the photosensitive layer 6 satisfies the expression of $[(Rz1)\geq(\lambda)/(4\times(n2))]$, and thus locations at which the incident and transmitting light and the reflected and transmitting light are strengthened (amplified) by interference, and locations at which the incident and transmitting light and the reflected and transmitting light are weakened (destructed) by the interference are finely dispersed and present together, and the occurrence of density unevenness of an image due to interference is prevented.

When the outermost surface of the surface layer has the same surface shape as the outermost surface of the photosensitive layer, that is, when a shape of the roughness of the outermost surface of the photosensitive layer is provided at a position at which the outermost surface of the surface layer overlaps the outermost surface of the photosensitive layer in the thickness direction of the surface layer, even if the surface roughness (Rz1) of the outermost surface of the photosensitive layer satisfies the expression of $[(Rz1)\geq(\lambda)/(4\times(n2))]$, the exposure light which is incident in the vertical direction does not have a varying difference in optical path between the top portion and the bottom portion of the roughness of the outermost surface of the photosensitive layer. Thus, it is considered that an effect of prevention of image density unevenness occurring by interference is not obtained.

Surface Roughness (Rz1) and (Rz2)

In this exemplary embodiment, the surface roughness (Rz1) of the outermost surface of the photosensitive layer and the surface roughness (Rz2) of the outermost surface of the surface layer mean the maximum height roughness Rz defined in JIS B0601 (2001).

The maximum height roughness Rz is measured based on JIS B0601 (2001). Specifically, the maximum height roughness Rz is obtained by using an atomic force microscope (AFM, Dimension3100 AFM manufactured by Veeco Instruments Inc.).

When the surface roughness (Rz1) of the outermost surface of the photosensitive layer is measured in a state where the surface layer has been formed, firstly, the surface layer is separated from the photosensitive layer and the outermost surface layer of the photosensitive layer to be measured is exposed. A portion of the outermost surface layer of the photosensitive layer is cut out by using a cutter and thereby obtaining a measurement sample. Then, measurement is performed by the above method. The cross-section of the photoreceptor is observed by a SEM or a TEM, and the surface shape from the obtained image is analyzed. Thus, the maximum height roughness Rz is also obtained.

Surface Roughness (Rz1) of Outermost Surface of Photosensitive Layer

The surface roughness (Rz1) (nm) of the outermost surface of the photosensitive layer satisfies the following expression (1-a). When the surface roughness (Rz1) does not satisfy the following expression (1-a), the effect of prevention of image density unevenness is not expressed well.

$$(Rz1)\geq(\lambda)/(4\times(n2)) \qquad \text{Expression (1-a):}$$

Average Interval (Sm) in Roughness of Outermost Surface of Photosensitive Layer

It is preferable that projection portions and recessed portions (ruggedness) in the roughness of the outermost surface of the photosensitive layer are more finely distributed. That is, an interval of the ruggedness in the roughness is preferably small.

Specifically, the average interval (Sm) of the ruggedness in the roughness is preferably equal to or less than 100 μm, more preferably equal to or less than 50 μm, and further preferably equal to or less than 20 μm. Generally, half-tone dots in an image are formed so as to have an interval of about 100 μm. Thus, if the average interval (Sm) is in the above range, a portion at which exposure light strengthened by interference is more transmitted to the surface layer and a portion at which exposure light weakened by interference is less transmitted to the surface layer are mixed in half tone (image structure area) of one image. As a result, density unevenness in half tone of one image is averaged and the occurrence of density unevenness in the image is more prevented. Variance of the size of dots may be also prevented.

When the surface roughness (Rz1) is measured by using an atomic force microscope (AFM, Dimension3100 AFM manufactured by Veeco Instruments Inc.), a roughness curve is obtained from a three-dimensional shape of the surface observed by the atomic force microscope. An average value of intervals in one cycle between the top and the bottom in the roughness is obtained from intersection points at which the roughness curve intersects with an average line, and thereby the average interval (Sm) of the ruggedness is calculated.

A method of controlling the outermost surface of the photosensitive layer to have a range of the surface roughness (Rz1) and a range of the average interval (Sm) is not particularly limited. The outermost surface of the photosensitive layer may be controlled by using a generally-known method. For example, a method of causing a surface of the outermost surface layer of the photosensitive layer to contain a component for applying roughness, a method in which the outermost surface layer of the photosensitive layer is formed, and then roughening treatment is performed, and the like are exemplified.

As the method of causing a surface of the outermost surface layer of the photosensitive layer to contain a component for applying roughness, for example, a method in which particles are caused to be contained in the outermost surface layer, and the contained particles cause the roughness to be applied to the surface on the outermost surface side is exemplified. In this method, the surface roughness (Rz1) and the average interval (Sm) are adjusted by adjusting a particle diameter or the addition quantity of the particles, or the like. As roughening treatment in the method in which the outermost surface layer of the photosensitive layer is formed, and then the roughening treatment is performed, for example, mechanical roughening treatment and the like is used. An example of the mechanical roughening treatment includes sand-blasting treatment, liquid honing treatment, buffing, polishing by using a polishing sheet (lapping film and the like).

From a point of view of applying required properties to the outermost surface layer of the photosensitive layer, the method in which the roughness is applied to the surface by causing particles to be contained in the outermost surface layer is preferably. Particularly, from a point of view of preventing deformation of the outermost surface layer and reducing a crack of the surface layer, a more preferable method is a method in which inorganic particles (for example, silica particles) which function as a reinforcing material are caused to be contained in the outermost surface layer of the photosensitive layer and thereby applying the roughness to the surface. A specific form of the method will be described in detail later.

Surface Roughness (Rz2) of Outermost Surface of Surface Layer

It is preferable that the outermost surface of the surface layer has a surface shape different from the outermost surface of the photosensitive layer and the surface roughness (Rz2) (nm) of the outermost surface of the surface layer satisfies the following expression (2-a). The surface roughness (Rz2) more preferably satisfies the following expression (2-b).

$$(Rz2) \leq (Rz1)/2 \quad \text{Expression (2-a):}$$

$$(Rz2) \leq (Rz1)/4 \quad \text{Expression (2-b):}$$

The surface roughness (Rz2) satisfying the above expression causes a difference in optical path between the exposure light reflected at the top portion of the roughness and the exposure light reflected at the bottom portion thereof in the outermost surface of the photosensitive layer to be more reliably obtained and causes the density unevenness of an image occurring by interference to be prevented more.

The surface roughness (Rz2) (nm) of the outermost surface of the surface layer preferably satisfies the following expression (3-a), and more preferably satisfies the following expression (3-b).

$$(Rz2) \leq 60 \text{ nm} \quad \text{Expression (3-a):}$$

$$(Rz2) \leq 30 \text{ nm} \quad \text{Expression (3-b):}$$

Even when a case where an apparatus including a cleaning blade as a cleaning device (which performs cleaning by removing a toner on the surface of the photoreceptor and a foreign matter such as a discharge product) is applied, good cleaning performance is expressed by causing the surface roughness (Rz2) to satisfy the above expression. As a result, occurrence of image defects (horizontal band-shaped image defect and the like) due to poor cleaning is prevented.

From a point of view of the cleaning performance by using the cleaning blade, the surface roughness (Rz2) of the outermost surface of the surface layer becomes preferably small, that is, the surface roughness (Rz2) becomes preferably approximate to 0 nm.

A method of forming the surface layer so as to contact with the outermost surface of the photosensitive layer is not particularly limited, and a generally-known method may be used. For example, a method in which a coating liquid for forming the surface layer is prepared, applied, and dried, and thereby the surface layer is formed, a method in which the surface layer is formed on the surface of the photosensitive layer by using a vapor deposition method such as a vapor phase growth method, and the like are exemplified.

In a case of the method in which a coating liquid for forming the surface layer is prepared, applied, and dried, and thereby the surface layer is formed, generally, the roughness of the outermost surface of the photosensitive layer which is a lower layer is not reflected to the outermost surface of the surface layer as it is. That is, a surface layer having a surface shape different from the outermost surface of the photosensitive layer is formed. In the method using the coating liquid for forming the surface layer, as a method of controlling the surface roughness (Rz2) of the outermost surface of the surface layer to be in a range of the above expression, a method of adjusting a component in the coating liquid or a composition ratio thereof, a method of controlling viscosity of the coating liquid or a coating method, a method of adjusting drying conditions, if necessary, a method of adjusting conditions when heat treatment is performed after drying, and the like are exemplified.

In a case of the method in which the surface layer is formed on the surface of the photosensitive layer by using the vapor deposition method such as a vapor phase growth method, the outermost surface of the surface layer may have a surface shape which is formed so as to be the same as the outermost surface of the photosensitive layer (that is, a shape of the roughness of the outermost surface of the photosensitive layer may be formed at a position of the outermost surface of the surface layer, at which the outermost surface of the surface layer is overlapped with the outermost surface of the photosensitive layer in the thickness direction of the surface layer). In this case, for example, surface treatment for varying the shape of the roughness, such as polishing and roughening of the surface layer, is performed. Thus, in this exemplary embodiment, a configuration which corresponds to the sentence that "the outermost surface of the surface layer has a surface shape different from the outermost surface of the photosensitive layer" may be achieved. In the method using the vapor deposition method such as a vapor phase growth method, as the method of controlling the surface roughness (Rz2) of the outermost surface of the surface layer to be in the range of the above expression, a method of performing surface treatment for varying the shape of the roughness, such as polishing and roughening of the surface layer is also exemplified.

The surface treatment is not particularly limited and general method is employed. For example, the mechanical roughening treatment and the like is exemplified as the surface treatment. An example of the mechanical roughening treatment includes sand-blasting treatment, liquid honing treatment, buffing, polishing by using a polishing sheet (lapping film and the like).

Refractive Index

A refractive index (n1) of the outermost surface layer of the photosensitive layer and a refractive index (n2) of the surface layer may vary depending on the composition of each of the layers. A difference between the refractive index (n1) and the refractive index (n2) may be also changed by combination of the compositions of the outermost surface layer of the photosensitive layer and the surface layer. Thus, the refractive index (n1) and the refractive index (n2) may be in a range satisfying the following expression (4-a). Particularly, when an inorganic surface layer is provided on a surface of an organic photosensitive layer, a difference in refractive index between an organic material and an inorganic material tends to be increased and the difference tends to be in the range satisfying the following expression (4-a).

Here, as the difference in refractive index between both of the layers at an interface between the outermost surface layer of the photosensitive layer, and the surface layer becomes greater, reflection of the exposure light which occurs at the interface is increased. Thus, density unevenness of an image due to the interference between the incident and transmitting light and the reflected and transmitting light easily occurs. Particularly, when the refractive indices of the outermost surface layer of the photosensitive layer and the surface layer satisfy the following expression (4-a), the occurrence of density unevenness of an image tends to be increased.

However, in this exemplary embodiment, since the surface roughness (Rz1) of the outermost surface of the photosensitive layer satisfies the expression (1-a), and the outermost surface of the surface layer has a surface shape different from the outermost surface of the photosensitive layer, even when the refractive indices of the outermost surface layer of the photosensitive layer and the surface layer satisfy the following expression (4-a), the occurrence of density unevenness of an image is prevented.

$$|(n2)-(n1)|\geq 0.2 \qquad \text{Expression (4-a):}$$

A configuration of an image forming apparatus which includes the unit for an image forming apparatus according to this exemplary embodiment will be described below. For descriptions of the configuration of the image forming apparatus, first, a configuration of the electrophotographic photoreceptor will be described in detail with reference to the accompanying drawings. In the drawings, the same or corresponding components are denoted by the same reference signs and repetitive descriptions will be omitted.

Figure 7:
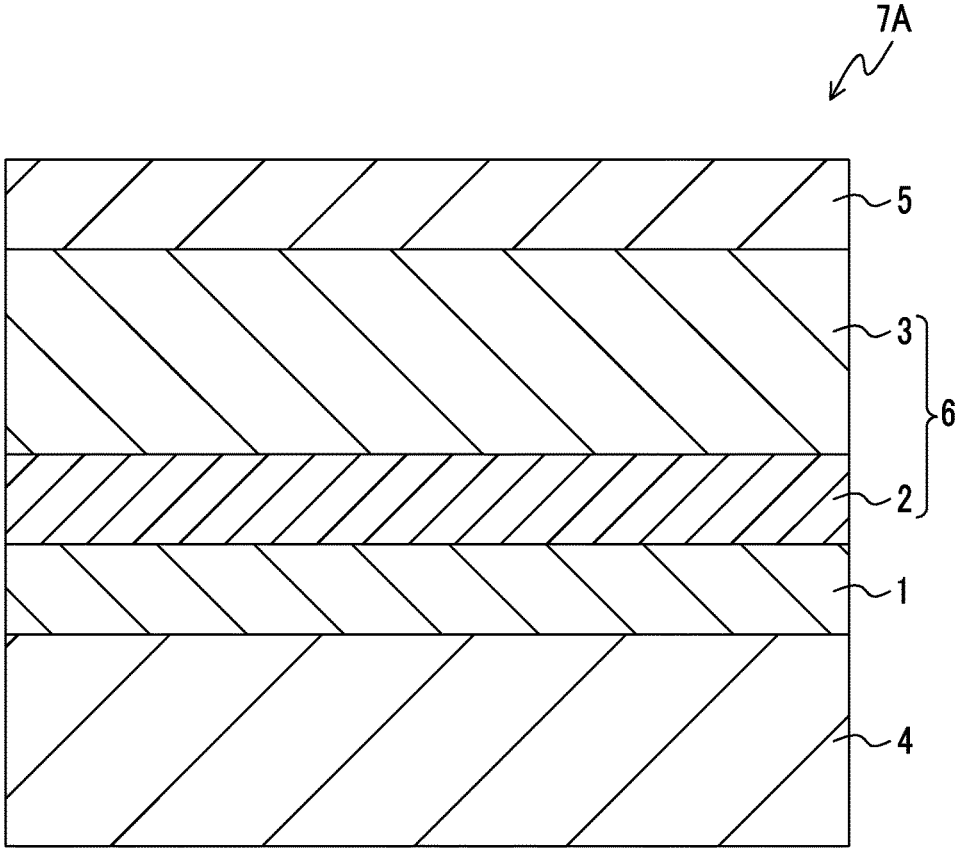
FIG. 7 is a schematic cross-sectional view illustrating an example of a layer configuration of the electrophotographic photoreceptor in this exemplary embodiment.
Figure 8:
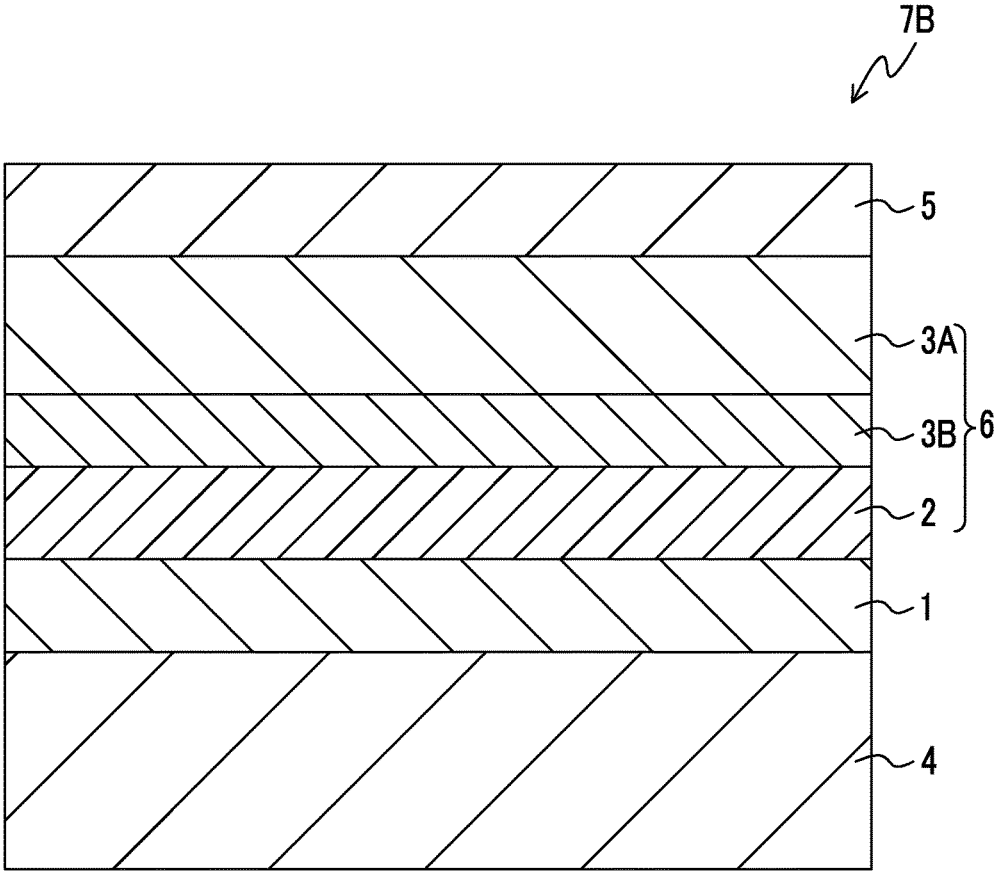
FIG. 8 is a schematic cross-sectional view illustrating another example of the layer configuration of the electrophotographic photoreceptor in this exemplary embodiment.
Figure 9:
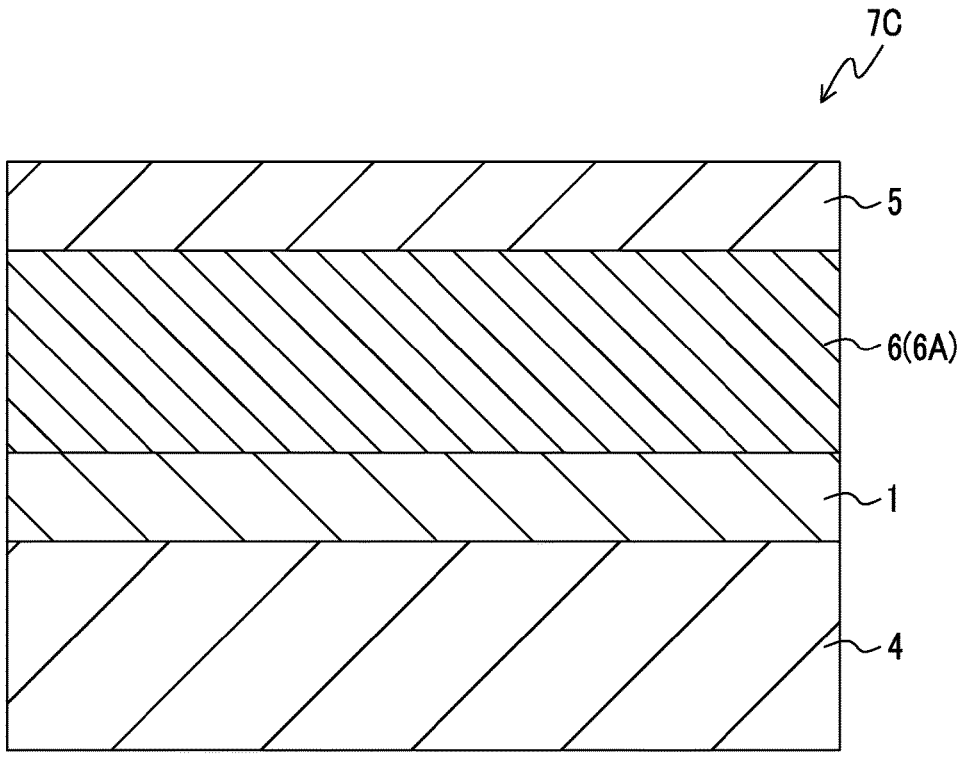
FIG. 9 is a schematic cross-sectional view illustrating still another example of the layer configuration of the electrophotographic photoreceptor in this exemplary embodiment.

FIG. 7 is a schematic cross-sectional view illustrating an example of the electrophotographic photoreceptor according to this exemplary embodiment. FIGS. 8 and 9 are schematic cross-sectional views illustrating another example of the electrophotographic photoreceptor in this exemplary embodiment.

An electrophotographic photoreceptor 7A illustrated in FIG. 7 is a so-called function separation type photoreceptor (or laminate type photoreceptor). The electrophotographic photoreceptor 7A has a structure in which an undercoat layer is provided on a conductive substrate 4, and a charge generating layer 2, a charge transport layer 3, and the surface layer 5 are sequentially formed on the undercoat layer 1. In the electrophotographic photoreceptor 7A, the charge generating layer 2 and the charge transport layer 3 constitute the photosensitive layer 6.

The charge transport layer 3 corresponds to the outermost surface layer of the photosensitive layer 6 and surface roughness (Rz1) of the outermost surface of this charge transport layer 3 satisfies the expression (1-a). The outermost surface of the surface layer 5 has a surface shape different from the charge transport layer 3.

Similarly to the electrophotographic photoreceptor 7A illustrated in FIG. 7, an electrophotographic photoreceptor 7B illustrated in FIG. 8 is a function separation type photoreceptor in which a function is divided so as to be performed in the charge generating layer 2 and the charge transport layer 3 and the function of the charge transport layer 3 is divided. In an electrophotographic photoreceptor 7C illustrated in FIG. 9, a charge generating material and a charge transporting material are contained in the same layer (single-layer type organic photosensitive layer 6A (charge generating/charge transport layer)).

The electrophotographic photoreceptor 7B illustrated in FIG. 8 has a structure in which the undercoat layer 1 is provided on the conductive substrate 4, and the charge generating layer 2, a charge transport layer 3B, a charge transport layer 3A, and the surface layer 5 are sequentially formed on the undercoat layer 1. In the electrophotographic photoreceptor 7B, the charge transport layer 3A, the charge transport layer 3B, and the charge generating layer 2 constitute the photosensitive layer 6.

The charge transport layer 3A corresponds to the outermost surface layer of the photosensitive layer 6 and surface roughness (Rz1) of the outermost surface of this charge transport layer 3A satisfies the expression (1-a). The outermost surface of the surface layer 5 has a surface shape different from the charge transport layer 3A.

The electrophotographic photoreceptor 7C illustrated in FIG. 9 has a structure in which the undercoat layer 1 is provided on the conductive substrate 4, and the single-layer type organic photosensitive layer 6A and the surface layer 5 are sequentially formed on the undercoat layer 1.

The single-layer type organic photosensitive layer 6A corresponds to the outermost surface layer of the photosensitive layer and surface roughness (Rz1) of the outermost surface of this single-layer type organic photosensitive layer 6A satisfies the expression (1-a). The outermost surface of the surface layer 5 has a surface shape different from the single-layer type organic photosensitive layer 6A.

In the electrophotographic photoreceptors illustrated in FIGS. 7 to 9, the undercoat layer 1 may or may not be provided.

Components will be described below based on the electrophotographic photoreceptor 7A illustrated in FIG. 7 as a representative example.

Conductive Substrate

Examples of the conductive substrate include metal plates, metal drums, and metal belts using metals (such as aluminum, copper, zinc, chromium, nickel, molybdenum, vanadium, indium, gold, and platinum), and alloys thereof (such as stainless steel). Further, other examples of the conductive substrate include papers, resin films, and belts which are coated, deposited, or laminated with a conductive compound (such as a conductive polymer and indium oxide), a metal (such as aluminum, palladium, and gold), or alloys thereof. The term "conductive" means that the volume resistivity is less than $10^{13}$ Ωcm.

When the electrophotographic photoreceptor is used in a laser printer, the surface of the conductive substrate is preferably roughened so as to have a centerline average roughness (Ra) of 0.04 μm to 0.5 μm sequentially to prevent interference fringes which are formed when irradiated by laser light. Further, when an incoherent light is used as a light source, surface roughening for preventing interference fringes is not particularly necessary, but occurrence of defects due to the irregularities on the surface of the conductive substrate is prevented, which is thus suitable for achieving a longer service life.

As the method for surface roughening, wet honing in which an abrasive is suspended in water and sprayed onto the support member, centerless grinding in which the conductive substrate is pressed on a rotating whetstone and grinding is continuously performed, an anodic oxidation treatment, and the like are included.

Other examples of the method for surface roughening include a method for surface roughening by forming a layer of a resin in which conductive or semiconductive particles are dispersed on the surface of a conductive substrate so that the surface roughening is achieved by the particles dispersed in the layer, without roughing the surface of the conductive substrate.

In the surface roughening treatment by anodic oxidation, an oxide film is formed on the surface of a conductive substrate by anodic oxidation in which a metal (for example, aluminum) conductive substrate as an anode is anodized in an electrolyte solution. Examples of the electrolyte solution include a sulfuric acid solution and an oxalic acid solution. However, the porous anodic oxide film formed by anodic oxidation without modification is chemically active, easily contaminated and has a large resistance variation depending on the environment. Therefore, it is preferable to conduct a sealing treatment in which fine pores of the anodic oxide film are sealed by cubical expansion caused by a hydration in pressurized water vapor or boiled water (to which a metallic salt such as a nickel salt may be added) to transform the anodic oxide into a more stable hydrated oxide.

The film thickness of the anodic oxide film is preferably from 0.3 μm to 15 μm. When the thickness of the anodic oxide film is within the above range, a barrier property against injection tends to be exerted and an increase in the residual potential due to the repeated use tends to be prevented.

The conductive substrate may be subjected to a treatment with an acidic aqueous solution or a boehmite treatment.

The treatment with an acidic treatment solution is, for example, carried out as follows. First, an acidic treatment solution including phosphoric acid, chromic acid, and hydrofluoric acid is prepared. The mixing ratio of phosphoric acid, chromic acid, and hydrofluoric acid in the acidic treatment solution is, for example, from 10% by weight to 11% by weight of phosphoric acid, from 3% by weight to 5% by weight of chromic acid, and from 0.5% by weight to 2% by weight of hydrofluoric acid. The concentration of the total acid components is preferably in the range of 13.5% by weight to 18% by weight. The treatment temperature is, for example, preferably from 42° C. to 48° C. The film thickness of the film is preferably from 0.3 μm to 15 μm.

The boehmite treatment is carried out by immersing the substrate in pure water at a temperature of 90° C. to 100° C. for 5 minutes to 60 minutes, or by bringing it into contact with heated water vapor at a temperature of 90° C. to 120° C. for 5 minutes to 60 minutes. The film thickness is preferably from 0.1 μm to 5 μm. The film may further be subjected to an anodic oxidation treatment using an electrolyte solution which sparingly dissolves the film, such as adipic acid, boric acid, borate, phosphate, phthalate, maleate, benzoate, tartrate, and citrate solutions.

Undercoat Layer

The undercoat layer is, for example, a layer including inorganic particles and a binding resin.

Examples of the inorganic particles include inorganic particles having powder resistance (volume resistivity) of about $10^2$ Ωcm to $10^{11}$ Ωcm.

Among these substances, as the inorganic particles having the resistance values above, metal oxide particles such as tin oxide particles, titanium oxide particles, zinc oxide particles, and zirconium oxide particles are preferable, and zinc oxide particles are more preferable.

The specific surface area of the inorganic particles as measured by a BET method is, for example, preferably equal to or greater than 10 $m^2/g$.

The volume average particle diameter of the inorganic particles is, for example, preferably from 50 nm to 2,000 nm (preferably from 60 nm to 1,000 nm).

The content of the inorganic particles is, for example, preferably from 10% by weight to 80% by weight, and more preferably from 40% by weight to 80% by weight, based on the binding resin.

The inorganic particles may be the ones which have been subjected to a surface treatment. The inorganic particles which have been subjected to different surface treatments or have different particle diameters may be used in combination of two or more types.

Examples of the surface treatment agent include a silane coupling agent, a titanate coupling agent, an aluminum coupling agent, and a surfactant. Particularly, the silane coupling agent is preferable, and a silane coupling agent having an amino group is more preferable.

Examples of the silane coupling agent having an amino group include 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane, but are not limited thereto.

These silane coupling agents may be used as a mixture of two or more types thereof. For example, a silane coupling agent having an amino group and another silane coupling agent may be used in combination. Other examples of the silane coupling agent include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane, but are not limited thereto.

The surface treatment method using a surface treatment agent may be any one of known methods, and may be either of a dry method and a wet method.

The amount of the surface treatment agent for treatment is, for example, preferably from 0.5% by weight to 10% by weight, based on the inorganic particles.

Here, inorganic particles and an electron acceptive compound (acceptor compound) are preferably included in the undercoat layer from the viewpoint of superior long-term stability of electrical characteristics and carrier blocking property.

Examples of the electron acceptive compound include electron transporting materials such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

Particularly, as the electron acceptive compound, compounds having an anthraquinone structure are preferable. As the electron acceptive compounds having an anthraquinone structure, hydroxyanthraquinone compounds, aminoanthraquinone compounds, aminohydroxyanthraquinone compounds, and the like are preferable, and specifically, anthraquinone, alizarin, quinizarin, anthrarufin, purpurin, and the like are preferable.

The electron acceptive compound may be included as dispersed with the inorganic particles in the undercoat layer, or may be included as attached to the surface of the inorganic particles.

Examples of the method of attaching the electron acceptive compound to the surface of the inorganic particles include a dry method and a wet method.

The dry method is a method for attaching an electron acceptive compound to the surface of the inorganic particles, in which the electron acceptive compound is added dropwise to the inorganic particles or sprayed thereto together with dry air or nitrogen gas, either directly or in the form of a solution in which the electron acceptive compound is dissolved in an organic solvent, while the inorganic particles are stirred with a mixer or the like having a high shearing force. The addition or spraying of the electron acceptive compound is preferably carried out at a temperature no higher than the boiling point of the solvent. After the addition or spraying of the electron acceptive compound, the inorganic particles may further be subjected to baking at a temperature of 100° C. or higher. The baking may be carried out at any temperature and timing without limitation, by which desired electrophotographic characteristics may be obtained.

The wet method is a method for attaching an electron acceptive compound to the surface of the inorganic particles, in which the inorganic particles are dispersed in a solvent by means of stirring, ultrasonic wave, a sand mill, an attritor, a ball mill, or the like, then the electron acceptive compound is added and the mixture is further stirred or dispersed, and thereafter, the solvent is removed. As a method for removing the solvent, the solvent is removed by filtration or distillation. After removing the solvent, the particles may further be subjected to baking at a temperature of 100° C. or higher. The baking may be carried out at any temperature and timing without limitation, in which desired electrophotographic characteristics may be obtained. In the wet method, the moisture contained in the inorganic particles may be removed prior to adding the electron acceptive compound, and examples of a method for removing the moisture include a method for removing the moisture by stirring and heating the inorganic particles in a solvent or by azeotropic removal with the solvent.

Furthermore, the attachment of the electron acceptive compound may be carried out before or after the inorganic particles are subjected to a surface treatment using a surface treatment agent, and the attachment of the electron acceptive compound may be carried out at the same time with the surface treatment using a surface treatment agent.

The content of the electron acceptive compound is, for example, preferably from 0.01% by weight to 20% by weight, and more preferably from 0.01% by weight to 10% by weight, based on the inorganic particles.

Examples of the binding resin used in the undercoat layer include known materials, such as well-known polymeric compounds such as acetal resins (for example, polyvinylbutyral and the like), polyvinyl alcohol resins, polyvinyl acetal resins, casein resins, polyamide resins, cellulose resins, gelatins, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, urethane resins, alkyd resins, and epoxy resins; zirconium chelate compounds; titanium chelate compounds; aluminum chelate compounds; titaniumalkoxide compounds; organic titanium compounds; and silane coupling agents.

Other examples of the binding resin used in the undercoat layer include charge transporting resins having charge transporting groups, and conductive resins (for example, polyaniline).

Among these substances, as the binding resin used in the undercoat layer, a resin which is insoluble in a coating solvent of an upper layer is suitable, and particularly, resins obtained by reacting thermosetting resins such as urea resins, phenol resins, phenol-formaldehyde resins, melamine resins, urethane resins, unsaturated polyester resins, alkyd resins, and epoxy resins; and resins obtained by a reaction of at least one kind of resin selected from the group consisting of polyamide resins, polyester resins, polyether resins, methacrylic resins, acrylic resins, polyvinyl alcohol resins, and polyvinyl acetal resins with a curing agent are suitable.

In the case where these binding resins are used in combination of two or more types thereof, the mixing ratio is set as appropriate.

Various additives may be used for the undercoat layer to improve electrical characteristics, environmental stability, or image quality.

Examples of the additives include known materials such as the polycyclic condensed type or azo type of the electron transporting pigments, zirconium chelate compounds, titanium chelate compounds, aluminum chelate compounds, titanium alkoxide compounds, organic titanium compounds, and silane coupling agents. A silane coupling agent, which is used for surface treatment of inorganic particles as described above, may also be added to the undercoat layer as an additive.

Examples of the silane coupling agent as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethylacetoacetate, zirconium triethanolamine, acetylacetonate zirconium butoxide, ethylacetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl) titanate, titanium acetyl acetonate, polytitaniumacetyl acetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxy aluminum diisopropylate, aluminum butylate, diethylacetoacetate aluminum diisopropylate, and aluminum tris(ethylacetoacetate).

These additives may be used singly, or as a mixture or a polycondensate of two or more types thereof.

The Vickers hardness of the undercoat layer is preferably equal to or greater than 35.

The surface roughness of the undercoat layer (ten point height of irregularities) is adjusted in the range of 1/(4n) (n indicates a refractive index of an upper layer) of a wavelength $\lambda$ to $(1/2)\lambda$. The wavelength $\lambda$ represents a wavelength of the laser for exposure and n represents a refractive index of the upper layer, in order to prevent a moire image.

Resin particles and the like may be added in the undercoat layer in order to adjust the surface roughness. Examples of the resin particles include silicone resin particles and cross-linked polymethyl methacrylate resin particles. In addition, the surface of the undercoat layer may be polished in order to adjust the surface roughness. Examples of the polishing method include buffing polishing, a sandblasting treatment, wet honing, and a grinding treatment.

The formation of the undercoat layer is not particularly limited, and well-known forming methods are used. However, the formation of the undercoat layer is carried out by, for example, forming a coating film of a coating liquid for forming an undercoat layer, the coating liquid obtained by adding the components above to a solvent, and drying the coating film, followed by heating, as desired.

Examples of the solvent for forming the coating liquid for forming the undercoat layer include known organic solvents such as alcohol solvents, aromatic hydrocarbon solvents, hydrocarbon halide solvents, ketone solvents, ketone alcohol solvents, ether solvents, and ester solvents.

Examples of these solvents include general organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a method for dispersing inorganic particles in preparing the coating liquid for forming an undercoat layer include known methods such as methods using a roll mill, a ball mill, a vibration ball mill, an attritor, a sand mill, a colloid mill, a paint shaker, and the like.

As a method of coating the conductive substrate with the coating liquid for forming an undercoat layer, general methods such as a blade coating method, a wire bar coating method, a spraying method, a dip coating method, a bead coating method, an air knife coating method, a curtain coating method, and the like are exemplified.

The film thickness of the undercoat layer is set to, for example, preferably be equal to or greater than 15 μm, and is set to be more preferably in a range of 20 μm to 50 μm.

Intermediate Layer

Although not illustrated in the drawings, an intermediate layer may be provided between the undercoat layer and the photosensitive layer.

The intermediate layer is, for example, a layer including a resin. Examples of the resin used in the intermediate layer include polymeric compounds such as acetal resins (for example polyvinylbutyral), polyvinyl alcohol resins, polyvinyl acetal resins, casein resins, polyamide resins, cellulose resins, gelatins, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer including an organometallic compound. Examples of the organometallic compound used in the intermediate layer include organometallic compounds containing a metal atom such as zirconium, titanium, aluminum, manganese, and silicon.

These compounds used in the intermediate layer may be used singly or as a mixture or a polycondensate of plural compounds.

Among these substances, layers containing organometallic compounds containing a zirconium atom or a silicon atom are preferable.

The formation of the intermediate layer is not particularly limited, and well-known forming methods are used. However, the formation of the intermediate layer is carried out, for example, by forming a coating film of a coating liquid for forming an intermediate layer, the coating liquid obtained by adding the components above to a solvent, and drying the coating film, followed by heating, as desired.

As a coating method for forming an intermediate layer, general methods such as a dip coating method, an extrusion coating method, a wire bar coating method, a spraying method, a blade coating method, a knife coating method, and a curtain coating method are used.

The film thickness of the intermediate layer is set to, for example, preferably from 0.1 μm to 3 μm. Further, the intermediate layer may be used as an undercoat layer.

Charge Generating Layer

The charge generating layer is, for example, a layer including a charge generating material and a binding resin. Further, the charge generating layer may be a layer in which a charge generating material is deposited. The layer in which the charge generating material is deposited is suitable for a case where a non-interfering light source such as a light emitting diode (LED) and an organic electro-luminescence (EL) image array.

Examples of the charge generating material include azo pigments such as bisazo and trisazo pigments; condensed aromatic pigments such as dibromoanthanthrone pigments; perylene pigments; pyrrolopyrrole pigments; phthalocyanine pigments; zinc oxides; and trigonal selenium.

Among these substances, in order to corresponding to laser exposure in the near-infrared region, it is preferable to use metal or nonmetal phthalocyanine pigments as the charge generating material, and specifically, hydroxygallium phthalocyanine, and the like; chlorogallium phthalocyanine; dichlorotin phthalocyanine; and titanyl phthalocyanine are more preferable.

In order to corresponding to laser exposure in the near-ultraviolet region, as the charge generating material, condensed aromatic pigments such as dibromoanthanthrone; thioindigo pigments; porphyrazine compounds; zinc oxides; trigonal selenium; bisazo pigments are preferable.

In the case of using non-interfering light sources such as LED having a light emitting center wavelength at 450 nm to 780 nm and organic EL image arrays, the above charge generating materials may be used, but from the viewpoint of resolution, when a photosensitive layer is used as a thin film having a thickness of 20 μm or less, the electrical strength in the photosensitive layer increases, and thus, a decrease in charging by charge injection from a substrate, or image defects such as so-called a black spots are easily formed. This becomes apparent when a charge generating material easily causing generation of dark currents as a p-type semiconductor such as trigonal selenium and phthalocyanine pigment is used.

On the contrary, in the case where n-type semiconductors such as condensed aromatic pigments, perylene pigments, azo pigments are used as a charge generating material, dark currents are not easily formed, and image defects called as a black spot may be prevented even when used as a thin film. Examples of the n-type charge generating material include the compounds (CG-1) to (CG-27) in paragraph Nos. [0288] to [0291] of JP-A-2012-155282, but are not limited thereto.

Determination of n-type ones may be conducted as follows: by employing a time-of-flight method commonly used, with the polarity of photocurrents, electrons that are easily flown out than holes as a carrier are determined as an n-type one.

The binding resin used in the charge generating layer may be selected from a wide range of insulating resins, and further, the binding resin may be selected from organic photoconductive polymers such as poly-N-vinyl carbazole, polyvinyl anthracene, polyvinyl pyrene, and polysilane.

Examples of the binding resin include polyvinyl butyral resins, polyarylate resins (polycondensates of bisphenols and aromatic divalent carboxylic acid or the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "insulating" means that the volume resistivity is $10^{13}$ Ω·cm or more.

These binding resins may be used singly or as a mixture of two or more kinds thereof.

Furthermore, the mixing ratio of the charge generating material and the binder resin is preferably in the range of 10:1 to 1:10 by weight ratio.

Well-known additives may be included in the charge generating layer.

The formation of the charge generating layer is not particularly limited, and well-known forming methods are used. However, the formation of the charge generating layer is carried out by, for example, forming a coating film of a coating liquid for forming a charge generating layer, the coating liquid obtained by adding the components above to a solvent, and drying the coating film, followed by heating, as desired. Further, the formation may also be carried out by deposition of a charge generating material. The formation of charge generating layer by deposition is particularly suitable for a case of using a condensed aromatic pigment or a perylene pigment as a charge generating material.

Examples of the solvent used for the preparation of the coating liquid for forming a charge generating layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. These solvents may be used singly or as a mixture of two or more kinds thereof.

For a method for dispersing particles (for example charge generating materials) in the coating liquid for forming a charge generating layer, for example, a media dispersing machine such as a ball mill, a vibrating ball mill, an attritor, a sand mill, and a horizontal sand mill, or a medialess dispersing machine such as a stirrer, an ultrasonic dispersing machine, a roll mill, and a high-pressure homogenizer is used. Examples of the high-pressure homogenizer include a collision system in which the particles are dispersed by causing the dispersion to collide against liquid or against walls under a high pressure, and a penetration system in which the particles are dispersed by causing the dispersion to penetrate through a fine flow path under a high pressure.

In addition, the average particle diameter of the charge generating materials in the coating liquid for forming a charge generating layer during the dispersion is effectively equal to or less than 0.5 μm, preferably equal to or less than 0.3 μm, and more preferably equal to or less than 0.15 μm.

As a method of coating the undercoat layer (or the intermediate layer) with the coating liquid for forming a charge generating layer, for example, general methods such as a blade coating method, a wire bar coating method, a spraying method, a dip coating method, a bead coating method, an air knife coating method, a curtain coating method, and the like are exemplified.

The film thickness of the charge generating layer is set to a range of, for example, preferably from 0.1 μm to 5.0 μm, and more preferably from 0.2 μm to 2.0 μm.

Charge Transport Layer

In the form illustrated in FIG. 7, a charge transport layer is provided as the outermost surface layer of the photosensitive layer. Surface roughness (Rz1) (nm) of the charge transport layer which corresponds to the outermost surface layer of the photosensitive layer satisfies the following expression (1-a).

Expression (1-a): $(Rz1) \geq (\lambda)/(4\times(n2))$

The method of controlling the charge transport layer (outermost surface layer of the photosensitive layer) to be in a range of the surface roughness (Rz1) is not particularly limited. However, for example, a method of causing a surface of the outermost surface layer of the photosensitive layer to contain a component (for example, particles such as silica particles) for applying the roughness to the surface thereof, a method in which the outermost surface layer of the photosensitive layer is formed, and then roughening treatment (for example, sand-blasting treatment, liquid honing treatment, buffing, using a polishing sheet (lapping film and the like)) is performed, and the like are exemplified.

A composition of the charge transport layer will be described below.

The charge transport layer contains a charge transporting material and, if necessary, contains a binding resin. In addition, the charge transport layer may contain a component (for example, particles such as silica particles) for applying the roughness to the outermost surface of the photosensitive layer.

Component for Applying Roughness

The component for applying the roughness to the outermost surface of the photosensitive layer by adding to the charge transport layer is not particularly limited. However, as the component, particles are preferably. The surface roughness (Rz1), the average interval (Sm), or the like of the outermost surface of the photosensitive layer may be adjusted by adjusting a particle diameter or the addition quantity of the particles, or the like.

The particles to be used are not particularly limited. However, either of inorganic particles and organic particles may be used. From a point of view of preventing deformation of the charge transport layer (outermost surface layer) and reducing a crack of the surface layer, inorganic particles which function as a reinforcing material of the charge transport layer (outermost surface layer) is preferable.

Examples of the inorganic particles include silica particles, alumina particles, silicon carbide particles, silicon nitride particles, boron nitride particles, metal oxide particles, carbon powder, and the like. Among these particles, from a point of view of a function as the reinforcing material, the silica particles are preferable.

Examples of the silica particles include dry silica particles and wet silica particles.

As the dry silica particle, combustion-method silica (fumed silica) and deflagration-method silica are exemplified. The combustion-method silica (fumed silica) is obtained by combusting a silane compound. The deflagration-method silica is obtained by explosively combusting metal silicon powder.

As the wet silica particles, wet silica particles obtained through a neutralization reaction of sodium silicate and mineral acid (sedimentation-method silica particles obtained through synthesis and aggregation under alkaline conditions, and gel-method silica particles obtained through synthesis and aggregation under acidic conditions), colloidal silica particles (silica-sol particles), and sol-gel silica particles are exemplified. The colloidal silica particles are obtained by changing silicic acid to be alkaline and performing polymerization. The sol-gel silica particles are obtained through hydrolysis of an organic silane compound (for example, alkoxysilane).

Among these types of particles, as the silica particles, the combustion-method silica particles which have a low void structure and in which the number of silanol groups on the surface is small are desirable.

The silica particle may have a surface subjected to the surface treatment by using a hydrophobizing agent. Thus, the number of silanol groups on the surface of the silica particle is reduced.

As the hydrophobizing agent, a well-known silane compound such as chlorosilane, alkoxysilane, and silazane is exemplified.

Among these substances, a silane compound which has a trimethylsilyl group, a decylsilyl group, or a phenyl silyl group is desirable as the hydrophobizing agent. That is, the trimethylsilyl group, the decylsilyl group, or the phenyl silyl group may be provided on the surface of the silica particle.

Examples of the silane compound having the trimethylsilyl group include trimethylchlorosilane, trimethylmethoxysilane, 1,1,1,3,3,3-hexamethyldisilazane, and the like.

Examples of the silane compound having the decylsilyl group include decyl trichlorosilane, decyl trichlorosilane, decyl dimethylchlorosilane, decyl trimethoxysilane, and the like.

Examples of the silane compound having the phenyl group include triphenyl methoxy silane, triphenyl chlorosilane, and the like.

A condensation ratio of the silica particles which are treated with the hydrophobizing agent (ratio of Si—O—Si in a bond of $SiO_4$— in a silica particle: being referred to as "a condensation ratio of the hydrophobizing agent" below) may be, for example, equal to or greater than 90% to the silanol groups on the surface of the silica particle, desirably equal to or greater than 91%, and more desirably equal to or greater than 95%.

If the condensation ratio of the hydrophobizing agent is in the above range, the number of silanol groups in the silica particle is reduced.

The condensation ratio of the hydrophobizing agent indicates a ratio of condensed silicon to all bondable sites of silicon at a condensation portion detected by a NMR. The condensation ratio of the hydrophobizing agent is measured as follows.

First, the silica particles are separated from the layer. Si CP/MAS NMR analysis is performed on the separated silica particles by using AVANCEIII 400 (manufactured by Bruker Corporation). A peak area in accordance with the number of substitution of SiO is obtained. Values of 2-substituted ($Si(OH)_2(0\text{-}Si)_2$—), 3-substituted ($Si(OH)\ (0\text{-}Si)_3$—), and 4-substituted ($Si(0\text{-}Si)_4$—) are respectively set as Q2, Q3, and Q4, and the condensation ratio of the hydrophobizing agent is calculated by using an expression of $(Q2\times2+Q3\times3+Q4\times4)/4\times(Q2+Q3+Q4)$.

Volume resistivity of inorganic particles such as the silica particles may be, for example, equal to or greater than $10^{11}$ Ω·cm, desirably equal to or greater than $10^{12}$ Ω·cm, and more desirably equal to or greater than $10^{13}$ Ω·cm.

If the volume resistivity of the inorganic particles is in the above range, deterioration of thin line reproducibility is prevented.

The volume resistivity of the inorganic particles is measured as follows. A measurement environment is set to be a temperature of 20° C. and humidity of 50% RH.

First, the inorganic particles are separated from the layer. The separated inorganic particles to be measured are disposed on a surface of a circular jig having an electrode plate of 20 $cm^2$ provided thereon, so as to have a thickness of 1 mm to 3 mm, and thereby forming an inorganic particle layer. A similar electrode plate of 20 $cm^2$ is placed on the formed inorganic particle layer, and thus the inorganic particle layer is interposed between the electrode plates. The thickness (cm) of the inorganic particle layer is measured after load of 4 kg is applied onto the electrode plate disposed on the inorganic particle layer in order to eliminate a void between inorganic particles. An electrometer and a high voltage power generating device are connected to both of the electrodes on and under the hydrophobic inorganic particle layer. A high voltage is applied to both of the electrodes such that an electric field has a determined value, and a current value (A) of a current flowing at this time is read, and thereby the volume resistivity (Ω·cm) of the inorganic particles are calculated. A calculation formula of the volume resistivity (Ω·cm) of the inorganic particles is as represented by the following expression.

In the expression, ρ indicates the volume resistivity (Ω·cm) of the hydrophobic inorganic particles. E indicates an application voltage (V). I indicates a current value (A) and $I_0$ indicates a current value (A) when the application voltage is 0V. L indicates the thickness (cm) of the hydrophobic inorganic particle layer. In this evaluation, volume resistivity obtained when the application voltage is 1,000 V is used.

Expression: $\rho=E\times20/(I-I_0)/L$

A volume average particle diameter of particles such as the silica particle may be, for example, from 20 nm to 200 nm, desirably from 30 nm to 200 nm, and more desirably from 40 nm to 150 nm.

Particles are separated from the layer, and 100 primary particles among the separated particles are observed at magnification of 40,000 by a scanning electron microscope (SEM). The maximum length of each of the particles in a major axis and the minimum length thereof in a minor axis are measured through image analysis of the primary particles, and a sphere equivalent diameter is measured from an intermediate value between the maximum length and the minimum length. A 50% diameter (D50v) in cumulative frequency of the obtained sphere equivalent diameter is obtained, and the volume average particle diameter is measured by using the obtained 50% diameter as the volume average particle diameter of the particles.

In this exemplary embodiment, the charge transport layer which functions as the outermost surface layer of the photosensitive layer preferably contains particles such as the silica particle so as to have a ratio of 30% by weight to 70% by weight with respect to the entirety of the charge transport layer. The content of the particles is in the above range, and thus the surface roughness (Rz1) or the average interval (Sm) of the outermost surface of the photosensitive layer is easily adjusted so as to be in the above-described range.

Charge Transporting Material

Examples of the charge transporting material include electron transporting compounds, such as quinone compounds such as p-benzoquinone, chloranil, bromanil, and anthraquinone; tetracyanoquinodimethane compounds; fluorenone compounds such as 2,4,7-trinitro fluorenone; xanthone compounds; benzophenone compounds; cyanovinyl compounds; and ethylene compounds. Other examples of the charge transporting material include hole transport compounds such as triarylamine compounds, benzidine compounds, arylalkane compounds, aryl substituted ethylene compounds, stilbene compounds, anthracene compounds, and hydrazone compounds. These charge transporting materials may be used alone or in combination of two or more kinds thereof, but are not limited thereto.

The charge transporting material is preferably a triaryl amine derivative represented by the following formula (a-1) and a benzidine derivative represented by the following formula (a-2) from the viewpoint of charge mobility.

(a-1)

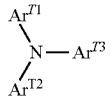

In the formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$, and $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituents of each of the above groups include a halogen atom, an alkyl group having 1 to 5 carbon atoms, an alkoxy group having 1 to 5 carbon atoms. Other examples of the substituents of each of the above groups include substituted amino groups substituted with an alkyl group having 1 to 3 carbon atoms.

(a-2)

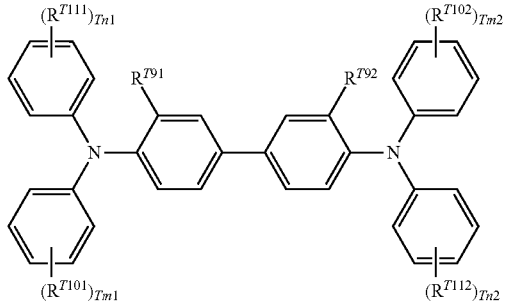

In the formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms; $R^{T101}$, $R^{T102}$, $R^{T111}$ and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$; $R^{T12}$, $R^{T13}$, $R^{T14}$, $R^{T15}$ and $R^{T16}$ each independently represent a hydrogen atom, a substituted or unsubstituted alkyl group, or a substituted or unsubstituted aryl group; and Tm1, Tm2, Tn1 and Tn2 each independently represent an integer of 0 to 2.

Examples of the substituents of each of the above groups include a halogen atom, an alkyl group having 1 to 5 carbon atoms, an alkoxy group having 1 to 5 carbon atoms. Other examples of the substituents of each of the above groups include substituted amino groups substituted with an alkyl group having 1 to 3 carbon atoms.

Here, among the triarylamine derivatives represented by the formula (a-1) and the benzidine derivatives represented by the formula (a-2), triarylamine derivatives having "$—C_6H_4—CH=CH—CH=C(R^{T7})(R^{T8})$" and benzidine derivatives having "$—CH=CH—CH=C(R^{T15})(R^{T16})$" are particularly preferable from the viewpoint of charge mobility.

As the polymeric charge transporting material, known materials having charge transporting properties such as poly-N-vinyl carbazole and polysilane are used. The polyester polymeric charge transporting materials are particularly preferable.

When the charge transport layer contains the particles, the content of the charge transporting material in the charge transport layer may be equal to or greater than 40% by weight, desirably from 40% by weight to 70% by weight, and more desirably from 40% by weight to 60% by weight for a weight obtained by subtracting the weight of the particles from the weight of all components of the charge transport layer.

The content of the charge transporting material may be smaller than that of the silica particles.

If the content of the charge transporting material is in the above range, occurrence of the residual potential is easily prevented.

Binding Resin

Examples of the binding resin used in the charge transport layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinyl carbazole, and polysilane. Among these, polycarbonate resins and polyarylate resins are suitable as the binder resin. These binding resins may be used singly or in combination of two or more kinds thereof.

The mixing ratio of the charge transporting material to the binding resin is preferably from 10:1 to 1:5 by weight ratio.

In addition, well-known additives may be included in the charge transport layer.

Characteristics of Charge Transport Layer

Elastic modulus of the charge transport layer may be, for example, equal to or greater than 5 GPa, desirably equal to or greater than 6 GPa, and more desirably equal to or greater than 6.5 GPa.

If the elastic modulus of the charge transport layer is in the above range, occurrence of a crack of the surface layer is easily prevented.

In order to cause the elastic modulus of the charge transport layer to be in the above range, for example, a method of adjusting the particle diameter and the content of the inorganic particles such as the silica particles, and a method of adjusting the type and the content of the charge transporting material are exemplified.

The elastic modulus of the charge transport layer is measured as follows.

First, after the surface layer is separated from the photosensitive layer and the layer to be measured is exposed. A portion of the exposed layer is cut out by a cutter, and thereby obtaining a measurement sample.

A depth profile for the measurement sample is obtained by using Nano Indenter SA2 (manufactured by MTS Systems Corporation) and by using a continuous stiffness method (CSM) (U.S. Pat. No. 4,848,141). The elastic modulus is measured by using an average value which is obtained from measurement values at an indentation depth from 30 nm to 100 nm.

The film thickness of the charge transport layer may be, for example, from 5 μm to 50 μm, desirably from 10 μm to 40 μm, more desirably from 10 μm to 35 μm, and particularly desirably from 15 μm to 30 μm.

If the film thickness of the charge transport layer is in the above range, the occurrence of the crack of the surface layer and occurrence of the residual potential are easily prevented.

Formation of Charge Transport Layer

The formation of the charge transport layer is not particularly limited, and well-known forming methods are used. However, the formation of the charge transport layer is carried out by, for example, forming a coating film of a coating liquid for forming a charge transport layer, the coating liquid obtained by adding the components above to a solvent, and drying the coating film, followed by heating, as desired.

Examples of the solvent used for the coating solution for forming the charge transport layer include general organic solvents, such as aromatic hydrocarbons such as benzene, toluene, xylene, and chlorobenzene; ketones such as acetone and 2-butanone; aliphatic hydrocarbon halides such as methylene chloride, chloroform, and ethylene chloride; and cyclic or straight-chained ethers such as tetrahydrofuran and ethyl ether. These solvents may be used singly or in combination of two or more kinds thereof.

As the coating method used when the charge generating layer is coated with the coating liquid for forming a charge transport layer, general methods such as a blade coating method, a wire bar coating method, a spraying method, a dip coating method, a bead coating method, an air knife coating method, a curtain coating method, and the like are exemplified.

As a dispersion method used when particles (for example, silica particles) are dispersed in the coating liquid for forming a charge transport layer, for example, a media dispersing machine such as a ball mill, a vibrating ball mill, an attritor, a sand mill, and a horizontal sand mill, or a medialess dispersing machine such as an agitator, an ultrasonic dispersing machine, a roll mill, and a high-pressure homogenizer is used. Examples of the high-pressure homogenizer include a collision system, and a penetration system. In the collision system, the particles are dispersed by causing the dispersion to collide against liquid or against walls under a high pressure. In the penetration system, the particles are dispersed by causing the dispersion to penetrate through a fine flow path under a high pressure.

As post-treatment for causing the surface roughness (Rz1) of the outermost surface to be in the above-described range, the charge transport layer which corresponds to the outermost surface layer of the photosensitive layer may be subjected to surface treatment. For example, a method of performing roughening treatment is exemplified as the post-treatment. As the roughening treatment, for example, mechanical roughening treatment such as sand-blasting treatment, liquid honing treatment, buffing, polishing by using a polishing sheet (lapping film and the like) is used.

Surface Layer

The outermost surface of the surface layer has a surface shape different from the outermost surface of the photosensitive layer (outermost surface of the charge transport layer in the form illustrated in FIG. 7).

The surface roughness (Rz2) (nm) of the outermost surface of the surface layer preferably satisfies the above-described expression (2-a) of [(Rz2)≤(Rz1)/2] or an expression (3-a) of [(Rz2)≤60 nm].

A method of forming the surface layer so as to contact with the outermost surface of the photosensitive layer is not particularly limited. For example, a method in which the coating liquid for forming the surface layer is prepared, applied, and dried, and thereby the surface layer is formed, a method in which the surface layer is formed on the surface of the photosensitive layer by using a vapor deposition method such as a vapor phase growth method, and the like are exemplified.

In a case of the method using the coating liquid, generally, the roughness of the outermost surface of the photosensitive layer which is a lower layer is not reflected to the outermost surface of the surface layer as it is. That is, a surface layer having a surface shape different from the outermost surface of the photosensitive layer is formed.

In a case of the method using the vapor deposition method such as a vapor phase growth method, the outermost surface of the surface layer may have a surface shape which is formed so as to be the same as the outermost surface of the photosensitive layer (that is, a shape of the roughness of the outermost surface of the photosensitive layer may be formed at a position of the outermost surface of the surface layer, at which the outermost surface of the surface layer is overlapped with the outermost surface of the photosensitive layer in the thickness direction of the surface layer). In this case, for example, surface treatment for varying the shape of the roughness, such as polishing and roughening of the surface layer, is performed. Thus, the outermost surface of the surface layer may have a surface shape different from the outermost surface of the photosensitive layer.

From a point of view of preventing wear of the photoreceptor and achieving a longer service life, an inorganic surface layer is preferably used as the surface layer. Among such inorganic surface layers, a deposition inorganic surface layer obtained by using the vapor deposition method such as a vapor phase growth method is more preferable.

The surface layer will be described below by using the inorganic surface layer as an example.

Composition of Inorganic Surface Layer

The inorganic surface layer is a layer containing an inorganic material.

From a point of view of having mechanical strength and light-transmissive properties required as the surface layer, examples of the inorganic material include an inorganic material based on oxide, nitride, carbon, and silicon.

Examples of the oxide inorganic material include metal oxide such as gallium oxide, aluminum oxide, zinc oxide, titanium oxide, indium oxide, tin oxide, and boron oxide; and crystal mixture of the above types of metal oxide.

Examples of the nitride inorganic material includes metal nitride such as gallium nitride, aluminum nitride, zinc nitride, titanium nitride, indium nitride, tin nitride, and boron nitride; and crystal mixture of the above types of metal nitride.

Examples of the carbon inorganic material, and silicon inorganic material include diamond-shaped carbon (DLC), amorphous carbon (a-C), hydrogenated amorphous carbon (a-C:H), hydrogenated and fluorinated amorphous carbon (a-C:H), amorphous silicon carbide (a-SiC), hydrogenated amorphous silicon carbide (a-SiC:H), amorphous silicon (a-Si), hydrogenated amorphous silicon (a-Si:H) and the like.

The inorganic material may be crystal mixture of the oxide inorganic material and the nitride inorganic material.

Among these materials, metal oxide, particularly, oxide (desirably, gallium oxide) of group 13 is desirably used as the inorganic material because metal oxide is excellent in mechanical strength and light-transmissive properties, particularly, metal oxide has n-type conductivity, and is excellent in electrical conduction controllability.

That is, the inorganic surface layer may contain at least an element in the group 13 (particularly, gallium) and oxygen, and if necessary, may contain hydrogen. Containing of hydrogen causes physical properties of the inorganic surface layer which contains at least an element of the group 13 (particularly, gallium) and oxygen to be easily controlled.

Summation of an element constitution ratio of an element in the group 13, oxygen, and hydrogen to all components constituting the inorganic surface layer is preferably equal to or greater than 90% by atom.

An element composition ratio (oxygen/element in the group 13) of oxygen to an element in the group 13 is preferably from 1.1 to 1.5.

For example, the composition ratio [O]/[Ga] is changed from 1.0 to 1.5 in the inorganic surface layer containing gallium, oxygen, and hydrogen (for example, inorganic surface layer formed of gallium oxide containing hydrogen), and thus control of the volume resistivity to be in a range of $10^9$ Ω·cm to $10^{14}$ Ω·cm is easily realized.

In addition to the inorganic material, in order to control the electrical conduction type, the inorganic surface layer may contain one or more element selected from, for example, C, Si, Ge, and Sn in a case of an n-type conduction type, and the inorganic surface layer may contain one or more element selected from, for example, N, Be, Mg, Ca, and Sr in a case of a p-type conduction type.

Here, when the inorganic surface layer is formed to contain gallium and oxygen, and if necessary, hydrogen, an appropriate element constitution ratio is as follows, from a point of view of being excellent in mechanical strength, light-transmissive properties, and flexibility, and being excellent in electrical conduction controllability.

For example, the element constitution ratio of gallium may be from 15% by atom to 50% by atom, desirably from 20% by atom to 40% by atom, and more desirably from 20% by atom to 30% by atom, for all constituent elements of the inorganic surface layer.

For example, the element constitution ratio of oxygen may be from 30% by atom to 70% by atom, desirably from 40% by atom to 60% by atom, and more desirably from 45% by atom to 55% by atom, for all constituent elements of the inorganic surface layer.

For example, the element constitution ratio of hydrogen may be from 10% by atom to 40% by atom, desirably from 15% by atom to 35% by atom, and more desirably from 20% by atom to 30% by atom, for all constituent elements of the inorganic surface layer.

An atomic ratio (oxygen/gallium) may be greater than 1.50, and 2.20 or less. The atomic ratio (oxygen/gallium) is desirably from 1.6 to 2.0.

Here, the element constitution ratio of each of the elements, the atomic ratio, and the like in the inorganic surface layer are obtained in a state of including distribution in the thickness direction, by using Rutherford backsattering spectrometry (referred to as "RBS" below).

In the RBS, 3SDH Pelletron (manufactured by NEC Corporation) is used as an accelerator, RBS-400 (manufactured by CE&A Corporation) is used as an end station, and 3S-R10 is used as a system. The HYPRA program of CE&A Corporation is used for analysis.

Regarding measurement conditions of the RBS, He++ ion beam energy is set to 2.275 eV, a detection angle is set to 160°, and a grazing angle for an incident beam is set to 109°.

Specifically, RBS measurement is performed as follows.

First, a He++ ion beam is vertically incident to a sample. An angle of a detector to the ion beam is set to 160°. A signal of He which is backwardly scattered is measured. The composition ratio and the film thickness are determined based on the detected energy of He and the detected intensity. The spectrum thereof may be measured by using two detection angles, in order to improve accuracy for obtaining the composition ratio and the film thickness. Measurement is performed by using two detection angles which are different from each other in resolution of a depth direction and backward scattering mechanics, and results of the measurement are cross-checked. Thus, the accuracy is improved.

The number of He atoms which are backwardly scattered by target atoms is determined only by three factors. The three factors are 1) an atomic number of the target atom, 2) energy of the He atom before scattering, and 3) a scattering angle.

It is assumed that density is calculated based on the measured composition, and the thickness is calculated on this assumption. The margin of an error in density is within 20%.

The element constitution ratio of hydrogen is obtained through hydrogen forward scattering (referred to as "HFS" below).

In HFS measurement, 3SDH Pelletron (manufactured by NEC Corporation) is used as an accelerator, RBS-400 (manufactured by CE&A Corporation) is used as an end station, and 3S-R10 is used as a system. The HYPRA program of CE&A Corporation is used for analysis. Measurement conditions of the HFS are as follows.

He++ ion beam energy: 2.275 eV

Detection angle: 30° of grazing angle to incident beam at 160°

In the HFS measurement, an angle of the detector to the He++ ion beam is set to 30°, and a sample is set to be inclined to a normal line by 75°. A signal of hydrogen which is scattered on the front of the sample is picked under these settings. At this time, the detector may be covered with an aluminium foil, and He atoms which are scattered along with hydrogen may be removed. Determination of the quantity is performed in such a manner that hydrogen in a reference sample and a sample to be measured is counted, values obtained by the counting are standardized with stopping power, and then the standardized values are compared to each other. A sample obtained by injecting ions of H into Si, and muscovite are used as the reference sample.

It is known that muscovite has a hydrogen concentration of 6.5% by atom.

H adhering to the outermost surface is corrected by subtracting the quantity of H adhering to a clean Si surface, for example.

Characteristics of Inorganic Surface Layer

The inorganic surface layer may have distribution of the composition ratio in the thickness direction, in accordance with the purpose. The inorganic surface layer may have a multilayer configuration.

The inorganic surface layer is desirably a non-single crystal film such as a crystallite film, a polycrystalline film, and an amorphous film. Among these films, the amorphous film is particularly desirable in smoothness of a surface. However, the crystallite film is more desirably in a point of hardness.

A growth section of the inorganic surface layer may have a columnar structure. However, from a point of view of slipperiness, a structure having high flatness is desirable and the amorphous film is desirable.

Crystallinity and amorphous properties are distinguished based on whether or not a dot or a line is in a diffraction image obtained through measurement using reflection high-energy electron diffraction (RHEED).

The volume resistivity of the inorganic surface layer may be equal to or greater than $10^6$ Ω·cm, and be desirably equal to or greater than $10^8$ Ω·cm.

If the volume resistivity is in the above range, flowing of charges in an in-plane direction is prevented and formation of a good electrostatic latent image is easily realized.

The volume resistivity is calculated and obtained from a resistance value, based on an area of an electrode and the thickness of a sample. The resistance value is measured under conditions of a frequency of 1 kHz and a voltage of 1 V by using LCR meter ZM2371 (manufactured by NF Corporation).

The measurement sample may be a sample obtained in such a manner that a film is formed on an aluminium base under the same conditions as conditions when an inorganic surface layer to be measured is formed, and a gold electrode is formed on the object obtained by forming the film, by vacuum deposition. The measurement sample may be a sample obtained in such a manner that an inorganic surface layer is separated from the prepared electrophotographic photoreceptor and a portion of the separated inorganic surface layer is etched, and the etched portion is interposed between a pair of electrodes.

The elastic modulus of the inorganic surface layer may be from 30 GPa to 80 GPa, and desirably from 40 GPa to 65 GPa.

If the elastic modulus is in the above range, generation of a recessed portion (indentation-shaped damage) in the inorganic surface layer is easily prevented, or separation of the inorganic surface layer or the occurrence of a crack in the inorganic surface layer is easily prevented.

A depth profile is obtained by the continuous stiffness method (CSM) (U.S. Pat. No. 4,848,141) and by using Nano Indenter SA2 (manufactured by MTS Systems Corporation). An average value is obtained from measurement values at an indentation depth from 30 nm to 100 nm. The average value is used for the elastic modulus. Measurement conditions are as follows.

Measurement environment: 23° C., 55% RH

Use depressor: regular triangular pyramid depressor (Berkovic depressor), triangular pyramid depressor formed of diamond Test mode: CSM mode The measurement sample may be a sample obtained by forming a film on a base under the same conditions as conditions used when an inorganic surface layer to be measured is formed. The measurement sample may be a sample obtained in such a manner that an inorganic surface layer is separated from the prepared electrophotographic photoreceptor and a portion of the separated inorganic surface layer is etched.

The film thickness of the inorganic surface layer may be, for example, from 0.2 μm to 10.0 μm, and desirably from 0.4 μm to 5.0 μm.

If the film thickness is in the above range, generation of a recessed portion (indentation-shaped damage) in the inorganic surface layer is easily prevented, or separation of the inorganic surface layer or the occurrence of a crack in the inorganic surface layer is easily prevented.

Formation of Inorganic Surface Layer

For example, a known vapor phase film deposition method is used for forming a surface layer. Examples of the known vapor phase film deposition method include a plasma chemical vapor deposition (CVD) method, an organometallic vapor phase growth method, a molecular beam epitaxy method, vapor deposition, sputtering, and the like.

Formation of an inorganic surface layer will be described below by using an example of a film forming apparatus with reference to the drawing, as a specific example. A method of forming an inorganic surface layer which contains gallium, oxygen, and hydrogen will be described below. However, it is not limited thereto, and a well-known forming method may be applied in accordance with a composition of a desired inorganic surface layer.

Figure 10A:
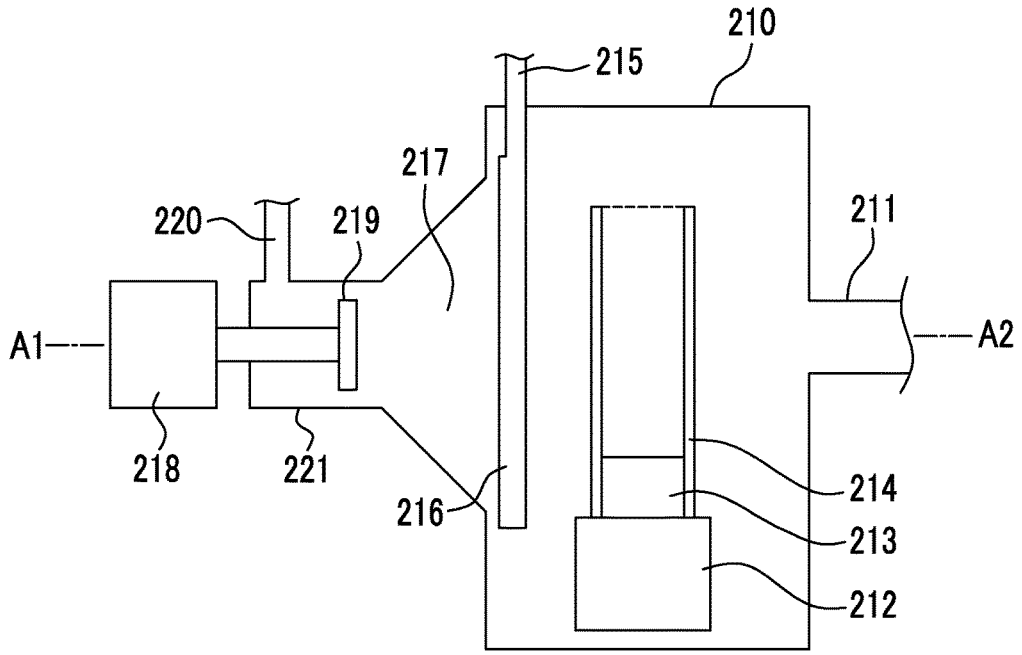
FIGS. 10A and 10B are schematic diagrams illustrating an example of a film forming apparatus used in forming of the surface layer of the electrophotographic photoreceptor in this exemplary embodiment.
Figure 10B:
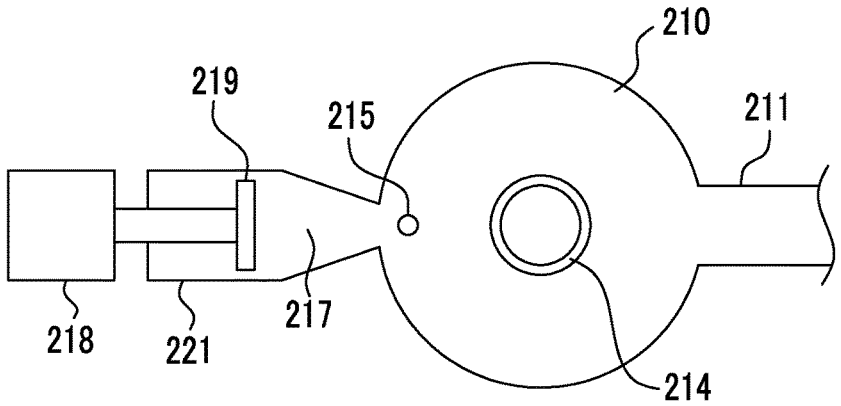

FIGS. 10A and 10B are schematic diagrams illustrating an example of the film forming apparatus used for forming the inorganic surface layer of the electrophotographic photoreceptor according to this exemplary embodiment. FIG. 10A illustrates a schematic cross-section when the film forming apparatus is viewed from a side. FIG. 10B illustrates a schematic cross-section obtained by taking the film forming apparatus illustrated in FIG. 10A along line A1-A2. In FIGS. 10A and 10B, the reference sign of 210 indicates a film formation chamber, and the reference sign of 211 indicates an exhaust port. The reference sign of 212 indicates a substrate rotating unit, and the reference sign of 213 indicates a substrate support member. The reference sign of 214 indicates a substrate, and the reference sign of 215 indicates a gas introduction tube. The reference sign of 216 indicates a shower nozzle which has an opening and ejects gas put from the gas introduction tube 215. The reference sign of 217 indicates a plasma diffusing portion, and the reference sign of 218 indicates a high-frequency power supply unit. The reference sign of 219 indicates an electrode plate, the reference sign of 220 indicates a gas introduction tube, and the reference sign of 221 indicates a high-frequency discharge tube portion.

In the film forming apparatus illustrated in FIGS. 10A and 10B, the exhaust port 211 is provided at one end of the film formation chamber 210. The exhaust port 211 is connected to a vacuum evacuation device (not illustrated). The high-frequency power supply unit 218, the electrode plate 219, and the high-frequency discharge tube portion 221 constitute a plasma generating apparatus. The plasma generating apparatus is provided on an opposite side of the film formation chamber 210 side, on which the exhaust port 211 is provided.

The plasma generating apparatus includes the high-frequency discharge tube portion 221, the electrode plate 219, and the high-frequency power supply unit 218. The electrode plate 219 is disposed in the high-frequency discharge tube portion 221 and a discharge surface of the electrode plate 219 is provided on the exhaust port 211 side. The high-frequency power supply unit 218 is disposed on the outside of the high-frequency discharge tube portion 221 and is connected to a surface on an opposite side of the discharge surface of the electrode plate 219. The gas introduction tube 220 is connected to the high-frequency discharge tube portion 221. The gas introduction tube 220 is used for supplying gas into the high-frequency discharge tube portion 221. Another end of the gas introduction tube 220 is connected to a first gas supply source (not illustrated).

Figure 11:
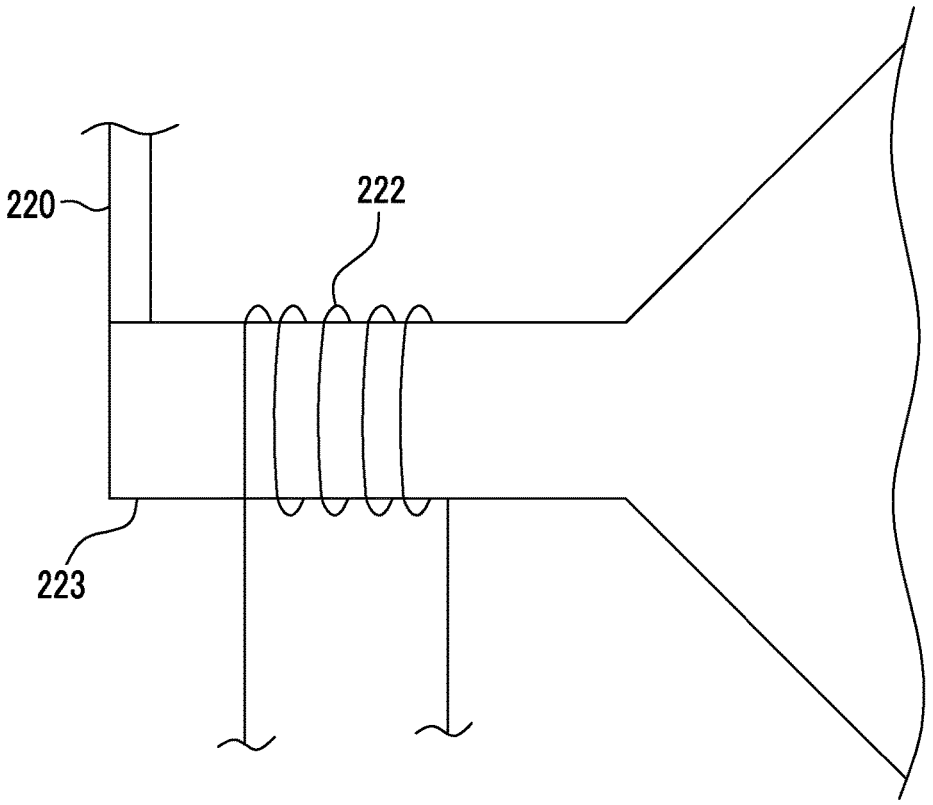
FIG. 11 is a schematic diagram illustrating an example of a plasma generating apparatus used in forming of the surface layer of the electrophotographic photoreceptor in this exemplary embodiment.

Instead of the plasma generating apparatus provided in the film forming apparatus illustrated in FIGS. 10A and 10B, a plasma generating apparatus illustrated in FIG. 11 may be used. FIG. 11 is a schematic diagram illustrating another example of the plasma generating apparatus used in the film forming apparatus illustrated in FIGS. 10A and 10B. FIG. 11 is a side view of the plasma generating apparatus. In FIG. 11, the reference sign of 222 indicates a high-frequency coil and the reference sign of 223 indicates a silica tube. The reference sign of 220 indicates a gas introduction tube, similarly to the gas introduction tube illustrated in FIGS. 10A and 10B. This plasma generating apparatus includes the silica tube 223, and the high-frequency coil 222 provided along an outer circumferential surface of the silica tube 223. One end of the silica tube 223 is connected to the film formation chamber 210 (not illustrated in FIG. 11). The gas introduction tube 220 for putting gas into the silica tube 223 is connected to another end of the silica tube 223.

In FIGS. 10A and 10B, the shower nozzle 216 is extended along the discharge surface and has a bar shape. In FIGS. 10A and 10B, the shower nozzle 216 is connected to the discharge surface side of the electrode plate 219, one end of the shower nozzle 216 is connected to the gas introduction tube 215, and the gas introduction tube 215 is connected to a second gas supply source (not illustrated) provided on the outside of the film formation chamber 210.

The substrate rotating unit 212 is provided in the film formation chamber 210. The cylindrical substrate 214 is attached to the substrate rotating unit 212 through the substrate support member 213 such that the shower nozzle 216 faces the substrate 214 along a longitudinal direction of the shower nozzle 216 and an axial direction of the substrate 214. When a film is formed, the substrate rotating unit 212 is rotated and thus the substrate 214 is rotated in a circumferential direction. As the substrate 214, for example, a photoreceptor in which layers up to an organic photosensitive layer have been layered in advance, and the like is used.

The inorganic surface layer is formed, for example, as follows.

First, oxygen gas (or helium (He) diluted oxygen gas) and helium (He) gas, and if necessary, hydrogen ($H_2$) gas are put into the high-frequency discharge tube portion 221 from the gas introduction tube 220, and a radio wave of 13.56 MHz is supplied to the electrode plate 219 from the high-frequency power supply unit 218. At this time, the plasma diffusing portion 217 is formed so as to be widened from the discharge surface side of the electrode plate 219 to the exhaust port 211 side. Here, the gas put from the gas introduction tube 220 flows toward the exhaust port 211 side from the electrode plate 219 side through the film formation chamber 210. The electrode plate 219 may be obtained by surrounding the electrode with a ground shield.

The shower nozzle 216 is positioned on a downstream side of the electrode plate 219 which is an activation section. Trimethyl gallium gas is put into the film formation chamber 210 through the gas introduction tube 215 and the shower nozzle 216. A non-single crystal film which contains gallium and oxygen is formed on the surface of the substrate 214.

As the substrate 214, for example, a substrate on which an organic photosensitive layer is formed is used.

Since an organic photoreceptor including an organic photosensitive layer is used, the temperature of the surface of the substrate 214 when the inorganic surface layer is formed is desirably equal to or lower than 150° C., more desirably equal to or lower than 100° C., and particularly desirably from 30° C. to 100° C.

Even when the temperature of the surface of the substrate 214 is equal to or lower than 150° C. at initial time when film formation is started, if the temperature becomes higher than 150° C. by an influence of plasma, the organic photosensitive layer may have damage due to heat. Thus, the surface temperature of the substrate 214 is desirably controlled considering this influence.

The temperature of the surface of the substrate 214 may be controlled by a heating section, a cooling section, and the like (not illustrated in the drawings). In addition, the temperature of the surface of the substrate 214 may be naturally increased during discharging. When the substrate 214 is heated, a heater may be installed on the outside or the inside of the substrate 214. When the substrate 214 is cooled, cooling gas or a cooling liquid may be circulated inside the substrate 214.

When an increase of the temperature of the surface of the substrate 214 occurring by discharge is wanted to be avoided, it is effective that a gas flow having high energy which abuts on the surface of the substrate 214 be adjusted. In this case, conditions of a flow rate of the gas, an discharge output, pressure, and the like are adjusted so as to cause the temperature of the surface of the substrate 214 to be a required temperature.

Instead of the trimethyl gallium gas, an organometal compound containing aluminium, and hydride such as diborane may be used. In addition, combination of two or more types of these materials may be used.

For example, if trimethyl indium is put into the film formation chamber 210 through the gas introduction tube 215 and the shower nozzle 216, and thus a film containing nitrogen and indium is formed on the substrate 214, at initial time of formation of the inorganic surface layer, this film absorbs ultraviolet rays which are generated during continuous film formation and deteriorates the organic photosensitive layer. Thus, damage on the organic photosensitive layer occurring due to generation of the ultraviolet rays during film formation is prevented.

As a method of doping a dopant when a film is formed, $SiH_3$ and $SnH_4$ in a gas state are used as an n-type material. Biscyclopentadienyl magnesium, dimethyl calcium, dimethyl strontium, and the like in a gas state are used as a p-type material. In order to dope a dopant element into the surface layer, known methods such as a thermal diffusion method and an ion implantation method may be employed.

Specifically, for example, gas contains at least one or more type of dopant elements, and this gas is put into the film formation chamber 210 through the gas introduction tube 215 and the shower nozzle 216. Thus, an inorganic surface layer having a conductive type such as an n-type and a p-type is obtained.

In the film forming apparatus described by using FIGS. 10A to 11, plural activation devices may be provided and independently controlled and thus active nitrogen or active hydrogen which is generated by discharge energy may be controlled. Gas such as $NH_3$, containing nitrogen atoms and hydrogen atoms together may be used. In addition, $H_2$ may be added or conditions of isolatedly generating active hydrogen from an organometal compound may be used.

The film is formed in this manner, and thus carbon atoms, gallium atoms, nitrogen atoms, and hydrogen atoms which have been activated are present on the surface of the substrate 214, in a state of being controlled. Thus, activated hydrogen atoms have an effect that hydrogen of hydrocarbon group such as methyl group or ethyl group, which constitutes the organometal compound is separated in a form of a hydrogen molecule.

Thus, a hard film (inorganic surface layer) for forming a three-dimensional bond is formed.

A plasma generation section of the film forming apparatus illustrated in FIGS. 10A to 11 uses a high-frequency oscillation device. However, it is not limited thereto. For example, a microwave oscillation device may be used or a device of an electrocyclotron resonance type or a helicon plasma type may be used. The high-frequency oscillation device may be an induction type or a capacity type.

Combination of two or more types of these devices may be used. In addition, two or more devices of the same type may be used. In order to prevent an increase of the surface temperature of the substrate 214 due to emission of plasma, the high-frequency oscillation device is desirable. However, a device of preventing emission of heat may be provided.

When two or more different types of plasma generating apparatuses (plasma generation sections) are used, it is desirable that discharge is caused to simultaneously occur at the same pressure in the plasma generating apparatuses. A pressure difference between an area in which discharge is performed, and an area in which a film is formed (portion at which the substrate is installed) may be provided. These devices may be disposed in series with a gas flow which is formed from a portion at which gas is put, to a portion at which the gas is discharged, in the film forming apparatus. Either of the devices may be disposed so as to face a surface of the substrate, on which a film is formed.

For example, when two types of plasma generation sections are installed so as to be in series with the gas flow, if the film forming apparatus illustrated in FIGS. 10A and 10B is used as an example, one of the two types of plasma generation sections is used as a second plasma generating apparatus which uses the shower nozzle 216 as an electrode and causes discharge in the film formation chamber 210. In this case, for example, a high-frequency voltage is applied to the shower nozzle 216 through the gas introduction tube 215 and thus discharge is caused in the film formation chamber 210 by using the shower nozzle 216 as an electrode. In addition, instead of using the shower nozzle 216 as an electrode, a cylindrical electrode is provided between the substrate 214 and the electrode plate 219 in the film formation chamber 210 and discharge is caused in the film formation chamber 210 by using the cylindrical electrode.

When two different types of plasma generating apparatuses are used under the same pressure, for example, when a microwave oscillation device and a high-frequency oscillation device are used, an excitation type of excitation energy may be greatly changed. Thus, the above case is effective in control of film quality. The discharge may be performed at the vicinity (from 70,000 Pa to 110,000 Pa) of atmospheric pressure. When the discharge is performed at the vicinity of the atmospheric pressure, He is desirably used as carrier gas.

Regarding formation of the inorganic surface layer, for example, a substrate 214 on which an organic photosensitive layer has been formed is installed in the film formation chamber 210. A gas mixture having different compositions is put into the film formation chamber 210, and the inorganic surface layer is formed.

Regarding film formation conditions, for example, when discharge is performed by using a high-frequency discharging method, the frequency is desirably in a range of 10 kHz to 50 MHz, in order to form a film of good quality at a low temperature. An output for discharge depends on the size of the substrate 214, but is desirably in a range of 0.01 $W/cm^2$ to 0.2 $W/cm^2$ for the surface area of the substrate. The rotation speed of the substrate 214 is desirably in a range of 0.1 rpm to 500 rpm.

Surface Treatment

When a surface layer is formed, if the surface layer is formed by using a vapor phase growth method such as plasma CVD as described above, a surface shape which is the same as the outermost surface of the photosensitive layer may be formed on the outermost surface of this surface layer (that is, a shape of the roughness of the outermost surface of the photosensitive layer may be formed at a position of the outermost surface of the surface layer, at which the outermost surface of the surface layer is overlapped with the outermost surface of the photosensitive layer in the thickness direction of the surface layer). In this case, for example, surface treatment for varying the shape of the roughness, such as polishing and roughening of the surface layer, is performed. Thus, in this exemplary embodiment, a configuration which corresponds to the sentence that "the outermost surface of the surface layer has a surface shape different from the outermost surface of the photosensitive layer" may be achieved.

The surface treatment is not particularly limited and general method is employed. For example, the mechanical roughening treatment and the like is exemplified as the surface treatment. An example of the mechanical roughening treatment includes sand-blasting treatment, liquid honing treatment, buffing, polishing by using a polishing sheet (lapping film and the like).

Here, a specific example of the surface treatment method performed by polishing with a polishing sheet will be described. Polishing is performed in such a manner that the polishing sheet is pressed while water is applied to a photoreceptor after the surface layer has been formed. Specifically, polishing is preferably performed by respectively pressing plural lapping films which have different abrasive grain sizes, plural times. The surface treatment is performed in this manner, and thus, for example, a configuration in which the outermost surface of the surface layer has a substantially smooth surface shape, that is, a configuration in which the outermost surface of the surface layer has a surface shape different from the outermost surface of the photosensitive layer is obtained.

Hitherto, an example in which the photosensitive layer is a function separation type and the charge transport layer is a single-layer type is described as the electrophotographic photoreceptor. However, in a case of the electrophotographic photoreceptor illustrated in FIG. 8 (example in which the photosensitive layer is a function separation type and the charge transport layer is a multi-layer type), the charge transport layer 3A which contacts with the surface layer 5 may have the same configuration as the charge transport layer 3 of the electrophotographic photoreceptor illustrated in FIG. 7. The charge transport layer 3B which does not contact with the surface layer 5 may have the same configuration as a well-known charge transport layer.

The film thickness of the charge transport layer 3A may be from 1 μm to 15 μm. The film thickness of the charge transport layer 3B may be from 15 μm to 29 μm.

In a case of the electrophotographic photoreceptor illustrated in FIG. 9 (example in which the photosensitive layer is a single-layer type), the single-layer type organic photosensitive layer 6A (charge generating/charge transport layer) may have the same configuration as the photosensitive layer 6 illustrated in FIG. 8 except for including the charge transport layer 3 and containing a charge transporting material.

The content of the charge generating material in the single-layer type organic photosensitive layer 6A may be from 25% by weight to 50% by weight for the entirety of the single-layer type organic photosensitive layer.

The film thickness of the single-layer type organic photosensitive layer 6A may be set to be from 15 μm to 30 μm.

Image Forming Apparatus (and Process Cartridge)

A configuration of the image forming apparatus and a process cartridge which include the unit for an image forming apparatus according to this exemplary embodiment will be described. The image forming apparatus and the process cartridge according to this exemplary embodiment have at least the electrophotographic photoreceptor and the exposure section which are included in the unit for an image forming apparatus.

The image forming apparatus according to this exemplary embodiment includes the electrophotographic photoreceptor, the charging section, an electrostatic latent image forming unit, the developing section, and the transfer section. The charging section charges the surface of the electrophotographic photoreceptor. The electrostatic latent image forming section forms an electrostatic latent image on the charged surface of the electrophotographic photoreceptor. The developing section develops the electrostatic latent image which has been formed on the surface of the electrophotographic photoreceptor, by using a developer containing a toner, so as to form a toner image. The transfer section transfers the formed toner image onto a surface of a recording medium. The electrophotographic photoreceptor according to this exemplary embodiment is applied as the above electrophotographic photoreceptor.

As the image forming apparatus according to this exemplary embodiment, a known image forming apparatus is applied: an apparatus including a fixing unit for fixing a toner image transferred onto a surface of a recording medium; a direct transfer apparatus that directly transfers a toner image formed on a surface of an electrophotographic photoreceptor onto a recording medium; an intermediate transfer apparatus that primarily transfers a toner image formed on a surface of an electrophotographic photoreceptor onto a surface of an intermediate transfer member, and then secondarily transfers the toner image which is primarily transferred onto the surface of the intermediate transfer member onto a surface of the recording medium; an apparatus including a cleaning unit that performs cleaning on a surface of an electrophotographic photoreceptor before charging; an apparatus including a neutralization unit that performs neutralization by irradiating a surface of an electrophotographic photoreceptor before charging with neutralizing light after a toner image is transferred; an apparatus including an electrophotographic photoreceptor heating member for increasing the temperature of the electrophotographic photoreceptor and reducing the relative temperature.

In the case of the intermediate transfer type device, for the transfer unit, for example, a configuration having an intermediate transfer member that has a surface to of which the toner image is transferred, a first transfer unit that primarily transfers a toner image formed on the surface of the electrophotographic photoreceptor to the surface of the intermediate transfer member, and a secondary transfer unit that secondarily transfers the toner image transferred to the surface of the intermediate transfer member is applied.

The image forming apparatus according to this exemplary embodiment may be any one of a dry developing type image forming apparatus, a wet developing type (developing type using a liquid developer) image forming apparatus.

In the image forming apparatus according to this exemplary embodiment, for example, a part including the electrophotographic photoreceptor may have a cartridge structure (process cartridge) which is detachable from the image forming apparatus. As the process cartridge, for example, a process cartridge including the electrophotographic photoreceptor according to this exemplary embodiment is applied. The process cartridge may include at least one selected from a group of, for example, the charging section, the electrostatic latent image forming section, the developing section, and the transfer section, in addition to the electrophotographic photoreceptor.

An example of the image forming apparatus according to this exemplary embodiment will be described below. However, the image forming apparatus is not limited to this example. Main components illustrated in the drawings will be described and descriptions of other components will be omitted.

Figure 12:
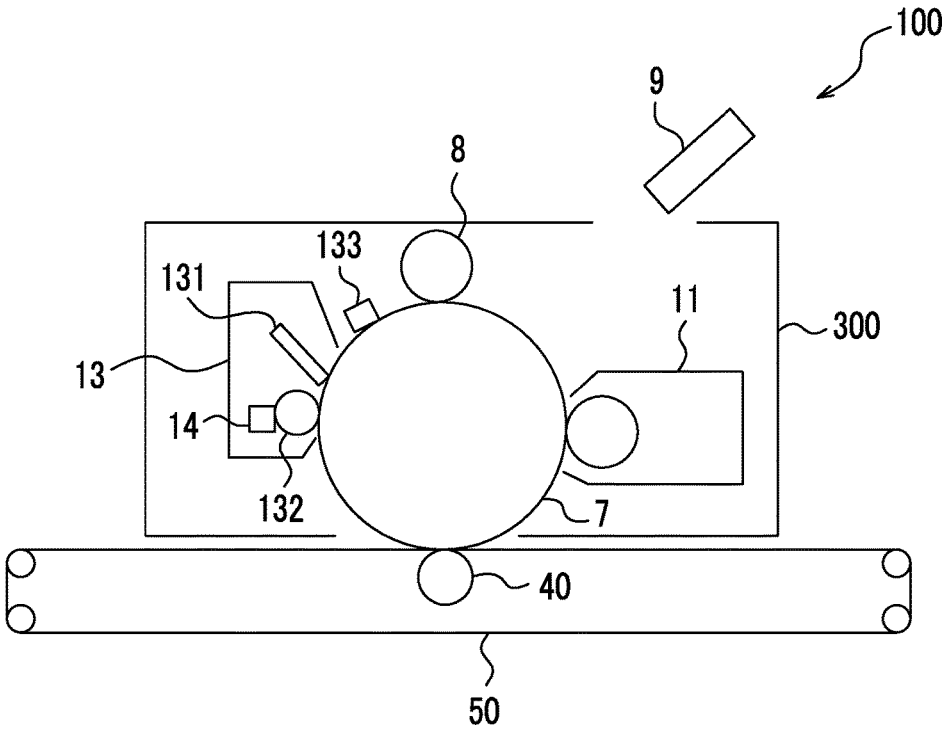
FIG. 12 is a schematic diagram illustrating an example of an image forming apparatus according to this exemplary embodiment.

FIG. 12 is a schematic configuration diagram illustrating an example of the image forming apparatus according to this exemplary embodiment.

As illustrated in FIG. 12, the image forming apparatus 100 according to this exemplary embodiment includes a process cartridge 300 which includes the electrophotographic photoreceptor 7, an exposure device (example of the exposure section) 9, a transfer device (example of a primary transfer device) 40, and an intermediate transfer member 50. In the image forming apparatus 100, the exposure device 9 is disposed at a position at which the exposure device 9 may radiate light onto the electrophotographic photoreceptor 7 through an opening in the process cartridge 300. The transfer device 40 is disposed at a position opposite to the electrophotographic photoreceptor 7 with the intermediate transfer member 50 interposed between the transfer device 40 and the electrophotographic photoreceptor 7. The intermediate transfer member 50 is disposed so as to partially contact with the electrophotographic photoreceptor 7. Although not illustrated in FIG. 12, the apparatus also includes a secondary transfer device that transfers a toner image which has been transferred onto the intermediate transfer member 50 to a recording medium (for example, paper). The intermediate transfer member 50, the transfer device (primary transfer device) 40, and the secondary transfer device (not illustrated) correspond to an example of the transfer unit.

The process cartridge 300 in FIG. 12 supports, in a housing, the electrophotographic photoreceptor 7, a charging device (example of the charging section) 8, a developing device (example of the developing section) 11, and a cleaning device (example of the cleaning section) 13 as a unit. The cleaning device 13 includes a cleaning blade (example of the cleaning member) 131. The cleaning blade 131 is disposed so as to contact with the surface of the electrophotographic photoreceptor 7. The cleaning member may be conductive or insulating fibrous member in addition to a form of the cleaning blade 131. The cleaning member may independently use the fibrous member or may use the fibrous member along with the cleaning blade 131.

FIG. 12 illustrates an example in which a (roll-shaped) fibrous member 132 for supplying a lubricant 14 onto the surface of the electrophotographic photoreceptor 7, and a (flat brush-shaped) fibrous member 133 for assisting cleaning are included, as the image forming apparatus. However, these components may be disposed as necessary.

The components of the image forming apparatus according to this exemplary embodiment will be described below.

Charging Device

As the charging device 8, for example, a contact type charger is used. The contact type charger uses a conductive or semiconductive charging roll, a charging brush, a charging film, a charging rubber blade, a charging tube, and the like. In addition, known chargers themselves such as a non-contact type roller charger, scorotron charging device, and a corotron charging device utilizing corona discharge are also used.

Exposure Device

Examples of the exposure device 9 (example of the exposure section) includes an optical instrument for exposure of the surface of the electrophotographic photoreceptor 7, to rays such as a semiconductor laser ray, an LED ray, and a liquid crystal shutter ray in a predetermined image-wise manner. The wavelength of the light source may be a wavelength in a range of the spectral sensitivity wavelengths of the electrophotographic photoreceptor. As the wavelengths of semiconductor lasers, near infrared wavelengths that are laser-emission wavelengths near 780 nm are predominant. However, the wavelength of the laser ray to be used is not limited to such a wavelength, and a laser having an emission wavelength of 600 nm range, or a laser having any emission wavelength in the range of 400 nm to 450 nm may be used as a blue laser. In order to form a color image, it is effective to use a planar light emission type laser light source capable of attaining a multi-beam output.

Developing Device

As the developing device 11, for example, a common developing device, in which a developer is contacted or not contacted for developing, may be used. Such a developing device 11 is not particularly limited as long as it has the above-described functions, and may be appropriately selected according to the intended use. Examples thereof include a known developing device in which the single-component or two-component developer is applied to the electrophotographic photoreceptor 7 using a brush or a roller. Among these devices, the developing device using developing roller retaining developer on the surface thereof is preferable.

The developer used in the developing device 11 may be a single-component developer formed of a toner singly or a two-component developer formed of a toner and a carrier. Further, the toner may be magnetic or non-magnetic. As the developer, known ones may be applied.

Cleaning Device

As the cleaning device 13, a cleaning blade type device which includes the cleaning blade 131 is used.

In addition to the cleaning blade type, a fur brush cleaning type and a developing and simultaneous cleaning type may be employed.

Transfer Device

Examples of transfer device 40 include known transfer charging devices themselves, such as a contact type transfer charging device using a belt, a roller, a film, a rubber blade, or the like, a scorotron transfer charging device, and a corotron transfer charging device utilizing corona discharge.

Intermediate Transfer Member

As the intermediate transfer member 50, a shape of a belt (intermediate transfer belt) of polyimide, polyamideimide, polycarbonate, polyarylate, polyester, rubber, or the like, which semiconductivity is imparted to, is used. In addition, the intermediate transfer member may also have a shape of a drum, in addition to the shape of a belt.

Figure 13:
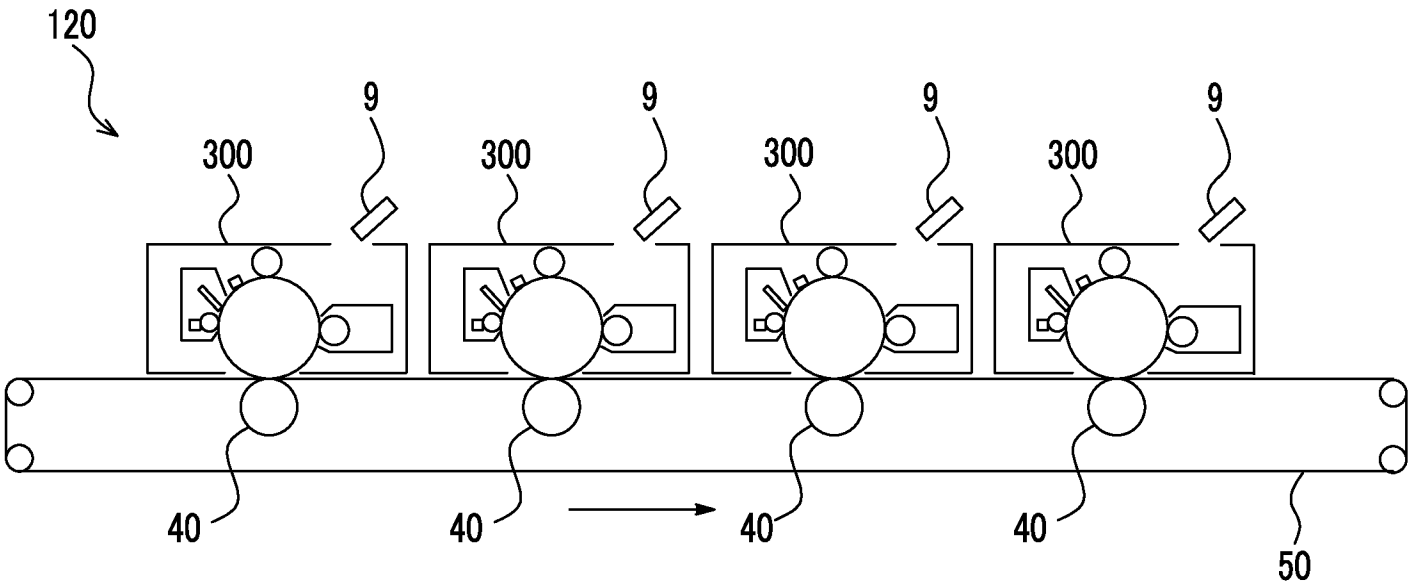
FIG. 13 is a schematic diagram illustrating another example of the image forming apparatus according to this exemplary embodiment.

FIG. 13 is a schematic configuration diagram illustrating another example of the image forming apparatus according to this exemplary embodiment.

An image forming apparatus 120 illustrated in FIG. 13 is a tandem multicolor image forming apparatus in which four process cartridges 300 are installed. In the image forming apparatus 120, the four process cartridges 300 on the intermediate transfer member 50 are disposed in parallel, and each process cartridge 300 has a configuration in which one electrophotographic photoreceptor to which one color is assigned is used. The image forming apparatus 120 may have a similar configuration to the image forming apparatus 100, in addition to the tandem type.

EXAMPLES

The exemplary embodiment of the invention will be specifically described below by using examples. However, the exemplary embodiment of the invention is not limited to the following examples.

Example 1

Preparation of Silica Particle (11)

30 parts by weight of trimethoxysilane (product name: 1,1,1,3,3,3-hexamethyldisilazane (manufacturer: Tokyo Chemical Industry Co., Ltd.)) are added as the hydrophobizing agent to 100 parts by weight of not-treated (hydrophilic) silica particles (product name: OX50 (manufacturer: Aerosil Corporation, particle diameter d=40 nm)) to perform a reaction for 24 hours. Then, filtration is performed to obtain silica particles treated with the hydrophobizing agent. The obtained silica particles are used as silica particles (11).

Formation of Undercoat Layer 100 parts by weight of zinc oxide (average particle size: 70 nm, product manufactured by Tayca Corporation, specific surface area value: 15 $m^2/g$) are mixed with 500 parts by weight of tetrahydrofuran with stirring. 1.3 parts by weight of the silane coupling agent (KBM503: product manufactured by Shin-Etsu Chemical Co., Ltd) are added and stirred for 2 hours. Then, distillation is performed under reduced pressure to distill away tetrahydrofuran. Baking is performed at 120° C. for 3 hours, and thus, zinc oxide particles surface-treated with the silane coupling agent are obtained.

110 parts by weight of the zinc oxide particles subjected to the surface treatment and 500 parts by weight of tetrahydrofuran are mixed and stirred. A liquid in which 0.6 parts by weight of alizarin are dissolved in 50 parts by weight of tetrahydrofuran is added and stirring is performed at 50° C. for 5 hours. Then, filtration is performed under reduced pressure and thus zinc oxide having alizarin applied thereto is separated. Drying is performed under reduced pressure at 60° C., and thus, alizarin-applied zinc oxide is obtained.

60 parts by weight of alizarin-applied zinc oxide, 13.5 parts by weight of the curing agent (blocked isocyanate, Sumidur 3175 product manufactured by Sumitomo Bayer urethane Corporation), and 15 parts by weight of a butyral resin (S-LEC BM-1, product manufactured by Sekisui chemical Co., Ltd.) are dissolved in 85 parts by weight of methyl ethyl ketone, and thus, a solution is obtained. 38 parts by weight of the solution and 25 parts by weight of methyl ethyl ketone are mixed with each other, and the resultant mixture is dispersed for 2 hours in a sand mill with 1 mmϕ glass beads. Thus, a dispersion is obtained.

0.005 parts by weight of dioctyl tin dilaurate as a catalyst and 40 parts by weight of silicone resin particles (Tospearl 145, product manufactured by Momentive Performance Materials Inc.) are added to the obtained dispersion, to thereby obtain a coating liquid for forming an undercoat layer. An aluminium base having a diameter of 60 mm, a length of 357 mm, and a thickness of 1 mm is coated with the coating liquid by using a dip coating method. Drying and curing are performed at 170° C. for 40 minutes, and thus, an undercoat layer having a thickness of 19 μm is obtained.

Formation of Charge Generating Layer 15 parts by weight of a hydroxy gallium phthalocyanine as the charge generating material, 10 parts by weight of a vinyl chloride-vinyl acetate copolymer resin (VMCH, product manufactured by NUC Corporation) as the binding resin, and 200 parts by weight of n-butyl acetate are mixed. The resultant mixture is dispersed in a sand mill by using glass beads having a diameter of 1 mmϕ, for 4 hours. The hydroxy gallium phthalocyanine has diffraction peak at a position at which the Bragg angle)(2θ±0.2° in the X-ray diffraction spectrum using a Cukα characteristic X-ray is at least 7.3°, 16.0°, 24.9°, or 28.0°. 175 parts by weight of n-butyl acetate and 180 parts by weight of methyl ethyl ketone are added to the obtained dispersion and stirring is performed. Thus, a coating liquid for forming a charge generating layer is obtained. The undercoat layer is dip-coated with the coating liquid for forming a charge generating layer and is dried at the room temperature (25° C.), and thus, a charge generating layer having a film thickness of 0.2 μm is formed.

Formation of Charge Transport Layer 95 parts by weight of tetrahydrofuran is put into 20 parts by weight of the silica particles (11). 10 parts by weight of N,N'-diphenyl-N,N'-bis(3-methylphenyl)-(1,1'-diphenyl)-4,4'-diamine and 10 parts by weight of a bisphenol Z type polycarbonate resin (viscosity average molecular weight of 50,000) as the binding resin are added thereto while keeping a liquid temperature of 20° C. Mixing and stirring are performed for 12 hours, and thus, a coating liquid for forming a charge transport layer is obtained. The content thereof in the solid content of the silica particles is 50% by weight.

The charge generating layer is coated with the coating liquid for forming a charge transport layer, and is dried at 135° C. for 40 minutes, and thereby a charge transport layer having a film thickness of 30 μm is formed. With the above processes, a non-coated photoreceptor (1) in which the undercoat layer, the charge generating layer, and the charge transport layer are layered on an aluminium base in this order is obtained.

Formation of Inorganic Surface Layer

Then, an inorganic surface layer formed of gallium oxide containing hydrogen is formed on a surface of the non-coated photoreceptor (1). The inorganic surface layer is formed by using the film forming apparatus having a configuration illustrated in FIGS. 10A and 10B.

First, the non-coated photoreceptor (1) is placed on the substrate support member 213 in the film formation chamber 210 of the film forming apparatus. The film formation chamber 210 is subjected to vacuum evacuation through the exhaust port 211 until the pressure is 0.1 Pa.

Then, He-diluted 40% oxygen gas (flow rate 4.0 sccm) and hydrogen gas (flow rate 50 sccm) are put into the high-frequency discharge tube portion 221 in which the electrode plate 219 having a diameter of 85 mm is provided, from the gas introduction tube 220. A radio wave of 13.56 MHz is set to have an output of 150 W, matching is performed by using a tuner, and the radio wave is applied to the electrode plate 219. Thus, discharge from the electrode plate 219 is performed by the high-frequency power supply unit 218 and a matching circuit (not illustrated in FIG. 4). At this time, the reflected wave has 0 W.

Then, trimethyl gallium gas (flow rate 5.0 sccm) is put into the plasma diffusing portion 217 in the film formation chamber 210, from the shower nozzle 216 through the gas introduction tube 215. At this time, reaction pressure in the film formation chamber 210, which is measured by a Baratron vacuum gage, is 5.3 Pa.

In this state, a film is formed for 180 minutes while the non-coated photoreceptor (1) is rotated at a speed of 500 rpm, and thus an inorganic surface layer having a film thickness of 3.0 μm is formed on a surface of the charge transport layer of the non-coated photoreceptor (1).

Surface Treatment for Inorganic Surface Layer

Polishing is performed in such a manner that the polishing sheet is pressed onto a photoreceptor having formed thereon the inorganic surface layer while water is applied. First, a diamond lapping film (product manufactured by 3M Corporation) having abrasive grains of 1 μm is pressed, and polishing is performed in a substantially uniform state until scar forms in the entirety of the photoreceptor. With respect to a direction changed, a diamond lapping film (product manufactured by 3M Corporation) having abrasive grains of 0.5 μm is pressed, and polishing is performed in a substantially uniform state until damage occurs in the entirety of the photoreceptor. With respect to a direction further changed, a diamond lapping film (product manufactured by 3M Corporation) having abrasive grains of 0.3 μm is pressed, and polishing is performed in a substantially uniform state until damage occurs in the entirety of the photoreceptor. With respect to a direction further changed, a diamond lapping film (product manufactured by 3M Corporation) having abrasive grains of 0.1 μm is pressed, and polishing is performed in a substantially uniform state until the surface has a substantially smooth surface shape (until a so-called mirror surface state occurs visually). In this manner, the inorganic surface layer is subjected to the surface treatment.

With the above processes, an electrophotographic photoreceptor in which the undercoat layer, the charge generating layer, the charge transport layer, and the inorganic surface layer are sequentially formed on a conductive substrate is obtained.

The surface roughness Rz1 of the outermost surface of the photosensitive layer and the surface roughness Rz2 of the outermost surface of the inorganic surface layer are measured by using an atomic force microscope according to the above-described method.

The average interval (Sm) of the roughness in the outermost surface of the photosensitive layer is measured by using the above-described method.

Evaluation

Figure 14:
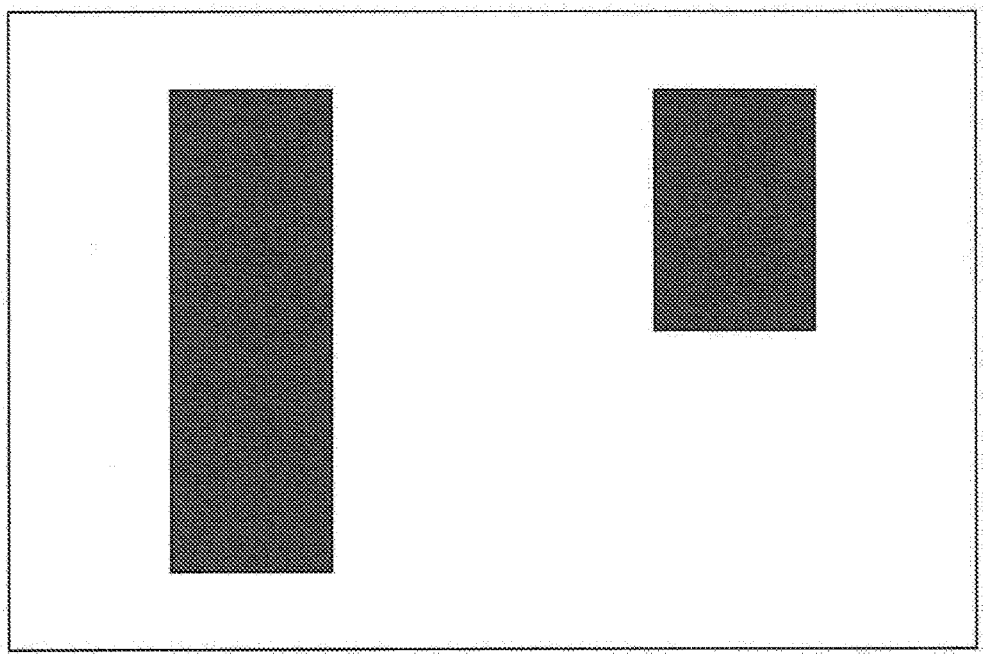
FIG. 14 is a schematic diagram illustrating an A4 chart printed in an evaluation test of an example.

The obtained photoreceptor is set in an image forming apparatus which is 700 Digital Color Press (product manufactured by Fuji Xerox Co., Ltd, exposure light wavelength λ=780 nm). 500 pieces of A4 charts illustrated in FIG. 14 are printed under an environment of a temperature of 28° C. and humidity of 85%. The, the apparatus is allowed to stand for 12 hours after the power is off. After 12 hours, a half-tone image having a Cin of 30% is output and the obtained image as an "initial image" is visually evaluated.

Next, 49,500 pieces (total 50,000 pieces) of A4 charts illustrated in FIG. 14 are printed under conditions as described above. Then, the apparatus is allowed to stand for 12 hours after the power is off. After 12 hours, a half-tone image having a Cin of 30% is output and the obtained image as an "image after 50,000 pieces" is visually evaluated.

50,000 pieces (total 100,000 pieces) of A4 charts illustrated in FIG. 14 are further printed under conditions as described above. Then, the apparatus is allowed to stand for 12 hours after the power is off. After 12 hours, a half-tone image having a Cin of 30% is output and the obtained image as an "image after 100,000 pieces" is visually evaluated.

Evaluation criteria are as follows.

A: neither of image defect nor image density unevenness is confirmed at both a vertical band and a horizontal band B: image defect is confirmed at a horizontal band C: image density unevenness is confirmed at a vertical band

Example 2

An electrophotographic photoreceptor is obtained in the same manner as in Example 1 except that the silica particles (11) used for preparing a charge transport layer in Example 1 is changed to "the product name: RX-40S (manufacturer:

Aerosil Corporation, particle diameter d=80 nm)", and evaluation is performed in the same manner as in Example 1.

Example 3

An electrophotographic photoreceptor is obtained in the same manner as in Example 2 except that the conditions of the surface treatment performed on the inorganic surface layer in Example 2 are changed and the surface roughness Rz2 of the outermost surface of the inorganic surface layer is adjusted so as to be in a range described in the following Table 1, and evaluation is performed in the same manner as in Example 2.

Example 4

An electrophotographic photoreceptor is obtained in the same manner as in Example 1 except that the conditions of the surface treatment performed on the inorganic surface layer in Example 1 are changed and the surface roughness Rz2 of the outermost surface of the inorganic surface layer is adjusted so as to be in a range described in the following Table 1, and evaluation is performed in the same manner as in Example 1.

Comparative Example 1

An electrophotographic photoreceptor is obtained in the same manner as in Example 2 except for the following difference, and evaluation is performed in the same manner as in Example 2. That is, after the charge transport layer is formed and before the inorganic surface layer is formed, polishing is performed by pressing a polishing sheet (diamond lapping film, product manufactured by 3M Corporation) while water is applied to the surface of the charge transport layer. The surface roughness Rz1 of the outermost surface of the photosensitive layer is adjusted so as to be in a range described in the following Table 1. The conditions of the surface treatment performed on the inorganic surface layer are also changed and the surface roughness Rz2 of the outermost surface of the inorganic surface layer is adjusted so as to be in a range described in the following Table 1.

Comparative Example 2

An electrophotographic photoreceptor is obtained in the same manner as in Example 1 except for the following difference, and evaluation is performed in the same manner as in Example 1. That is, the silica particles are not contained when the charge transport layer is formed, the inorganic surface layer is formed by using the above method, and then the surface treatment (surface polishing) is not performed.

TABLE 1

| | Charge transport layer | | | | Surface layer | | Expression | |
|---|---|---|---|---|---|---|---|---|
| | Silica diameter | Outermost surface Rz1 | Refractive index n1 | Average interval Sm in outermost surface | Outermost surface Rz2 | Refractive index n2 | (λ)/(4 × (n2)) | \|(n2) − (n1)\| |
| Example 1 | 40 nm | 202 nm | 1.65 | 2.2 μm | 12 nm | 1.92 | 101.6 | 0.27 |
| Example 2 | 80 nm | 116 nm | 1.65 | 1.9 μm | 10 nm | 1.92 | 101.6 | 0.27 |
| Example 3 | 80 nm | 116 nm | 1.65 | 1.9 μm | 52 nm | 1.92 | 101.6 | 0.27 |
| Example 4 | 40 nm | 202 nm | 1.65 | 2.1 μm | 64 nm | 1.92 | 101.6 | 0.27 |
| Comparative Example 1 | 80 nm [→ Polishing] | 65 nm | 1.65 | 5.0 μm | 9 nm | 1.92 | 101.6 | 0.27 |
| Comparative Example 2 | Not contained | 5.2 nm | 1.68 | 4.5 μm | 10.2 nm | 1.92 | 101.6 | 0.24 |

TABLE 2

| | Image quality evaluation result | | |
|---|---|---|---|
| | Initial image | Image after 50,000 pieces | Image after 100,000 pieces |
| Example 1 | A | A | A |
| Example 2 | A | A | A |
| Example 3 | A | A | A |
| Example 4 | B [Horizontal band] *1 | B [Horizontal band] *1 | B [Horizontal band] *1 |
| Comparative Example 1 | A | C [Vertical band] *2 | C [Vertical band] *2 |
| Comparative Example 2 | A | C [Vertical band] *2 | C [Vertical band] *2 |

(*1) In Example 4, in all of the initial image, the image after 50,000 pieces, and the image after 100,000 pieces, image defect at a horizontal band occurring by poor cleaning of the cleaning blade occurs. However, a brush cleaning device is further installed on a downstream side of the cleaning blade in a photoreceptor driving direction in the image forming apparatus, and thus occurrence of the image defect at the horizontal band is not confirmed. In all of the initial image, the image after 50,000 pieces, and the image after 100,000 pieces, evaluation is performed as "A".

(*2) In Comparative Example 1 and Comparative Example 2, in an evaluation test, after the image after 50,000 pieces is formed and after the image after 100,000 pieces is formed, occurrence of uneven wear on the surface of the photoreceptor is confirmed. The image density unevenness of a vertical band occurs at a position corresponding to the uneven wear.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor of which a surface is exposed with a light having a wavelength (λ) (nm) in a state where the surface is charged to thereby form an electrostatic latent image, wherein the electrophotographic photoreceptor includes a conductive substrate, a photosensitive layer provided on the conductive substrate, and a surface layer provided so as to contact with an outermost surface of the photosensitive layer, the surface layer having a thickness of from 0.2 μm to 10 μm, a surface roughness (Rz1) (nm) of the outermost surface of the photosensitive layer satisfies an expression of [(Rz1)≥(λ)/(4×(n2))] where a refractive index of the surface layer is set as (n2), and the surface layer is a polished surface layer by way of having been subjected to a mechanical roughening, the mechanical roughening being conducted until a surface roughness (Rz2) (nm) of an outermost surface of the surface layer satisfies an expression of [(Rz2)≤(Rz1)/2], and the outermost surface of the surface layer having a surface shape different from the outermost surface of the photosensitive layer.

2. A unit for an image forming apparatus, comprising:

an electrophotographic photoreceptor that includes a conductive substrate, a photosensitive layer provided on the conductive substrate, and a surface layer provided so as to contact with an outermost surface of the photosensitive layer; and an exposure section that exposes the electrophotographic photoreceptor with a light having a wavelength (λ) (nm) so as to form an electrostatic latent image on a charged surface of the electrophotographic photoreceptor, wherein the surface layer has a thickness of from 0.2 μm to 10 μm, wherein a surface roughness (Rz1) (nm) of the outermost surface of the photosensitive layer satisfies an expression of [(Rz1)≥(λ)/(4×(n2))] where a refractive index of the surface layer is set as (n2), and wherein the surface layer is a polished surface layer by way of having been subjected to a mechanical roughening, the mechanical roughening being conducted until a surface roughness (Rz2) (nm) of an outermost surface of the surface layer satisfies an expression of [(Rz2)≤(Rz1)/2], and the outermost surface of the surface layer having a surface shape different from the outermost surface of the photosensitive layer.

3. The unit for an image forming apparatus according to claim 2, wherein the surface roughness (Rz2) (nm) of the outermost surface of the surface layer satisfies an expression of [(Rz2)≤60 nm].

4. The unit for an image forming apparatus according to claim 2, wherein the refractive index (n2) of the surface layer and a refractive index (n1) of a layer forming the outermost surface of the photosensitive layer satisfy an expression of [|(n2)−(n1)|≥0.2].

5. The unit for an image forming apparatus according to claim 3, wherein the refractive index (n2) of the surface layer and a refractive index (n1) of a layer forming the outermost surface of the photosensitive layer satisfy an expression of [|(n2)−(n1)|≥0.2].

6. The unit for an image forming apparatus according to claim 2, wherein the photosensitive layer includes silica particles.

7. The unit for an image forming apparatus according to claim 2, wherein the surface layer is an inorganic surface layer, and the photosensitive layer is an organic photosensitive layer.

8. The unit for an image forming apparatus according to claim 3, wherein the surface layer is an inorganic surface layer, and the photosensitive layer is an organic photosensitive layer.

9. The unit for an image forming apparatus according to claim 4, wherein the surface layer is an inorganic surface layer, and the photosensitive layer is an organic photosensitive layer.

10. The unit for an image forming apparatus according to claim 5, wherein the surface layer is an inorganic surface layer, and the photosensitive layer is an organic photosensitive layer.

11. The unit for an image forming apparatus according to claim 2, wherein the surface layer is an inorganic surface layer that contains oxygen and gallium.

12. A process cartridge which is detachable from an image forming apparatus, the cartridge comprising:

the unit for an image forming apparatus according to claim 2.

13. An image forming apparatus comprising:

the unit for an image forming apparatus according to claim 2;

a charging section that charges the electrophotographic photoreceptor included in the unit for an image forming apparatus;

a developing section that develops an electrostatic latent image by a toner so as to form a toner image, the electrostatic latent image being formed on a surface of the electrophotographic photoreceptor by exposure from the exposure section included in the unit for an image forming apparatus; and a transfer section that transfers the toner image formed on the surface of the electrophotographic photoreceptor to a recording medium.

* * * * *